US007731319B2

(12) United States Patent
Murcia et al.

(10) Patent No.: US 7,731,319 B2
(45) **Date of Patent: *Jun. 8, 2010**

(54) IMAGING HEAD ELEVATOR

(75) Inventors: Antoni S. Murcia, Poway, CA (US); David L. Berardelli, San Diego, CA (US); Kelvin J. Hasseler, Murrieta, CA (US); Adam J. Livingston, San Marcos, CA (US); Srinivas Bhakthavatsalam, San Diego, CA (US); Kenneth C. Westfield, San Diego, CA (US); Charles L. Hayman, San Diego, CA (US); Mark A. Hay, Poway, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1110 days.

This patent is subject to a terminal disclaimer.

(21) Appl. No.: 11/105,687

(22) Filed: Apr. 14, 2005

(65) Prior Publication Data

US 2006/0232623 A1 Oct. 19, 2006

(51) Int. Cl.
*B41J 25/308* (2006.01)

(52) U.S. Cl. ..... 347/8; 347/19; 347/198

(58) Field of Classification Search ..... 347/4, 347/8, 20, 198, 33, 5, 19; 400/59
See application file for complete search history.

(56) References Cited

U.S. PATENT DOCUMENTS

| | | | | |
|---|---|---|---|---|
| 5,414,453 | A * | 5/1995 | Rhoads et al. | 347/8 |
| 5,825,392 | A | 10/1998 | Mochizuki et al. | |
| 6,149,262 | A | 11/2000 | Shiida et al. | |
| 6,217,145 | B1 | 4/2001 | Ito et al. | |
| 6,419,334 | B1 * | 7/2002 | Akuzawa et al. | 347/8 |
| 6,502,922 | B2 | 1/2003 | Kawase et al. | |
| 6,511,153 | B1 | 1/2003 | Ishikawa | |
| 6,802,590 | B2 * | 10/2004 | Lim | 347/33 |
| 6,874,956 | B2 * | 4/2005 | Kelley et al. | 400/59 |
| 2001/0038401 | A1 | 11/2001 | Kawase et al. | |
| 2004/0263602 | A1 | 12/2004 | Nakashima et al. | |

FOREIGN PATENT DOCUMENTS

| | | |
|---|---|---|
| EP | 0441425 | 8/1991 |
| JP | 2002079697 | 3/2002 |

OTHER PUBLICATIONS

Family: Anti-Creep Linear Slides, Del-Tron Precision Online Catalog, printed from website www.deltron.com/catalog/specifications on Feb. 10, 2005.
International Search results for PCT/US2006/013533 dated Aug. 23, 2006, 2 pgs.

* cited by examiner

*Primary Examiner*—Lam S Nguyen

(57) ABSTRACT

Various embodiments of an apparatus and method for lifting an imaging head are disclosed.

28 Claims, 12 Drawing Sheets

IMAGING HEAD ELEVATOR

BACKGROUND

In some applications, print quality may be dependent upon the spacing between an imaging head and media being printed upon. In some instances, the media may be abnormally thick, may include multiple sheets or may be irregular or bent. This may result in the media crashing into the imaging head and potentially damaging the imaging head.

DETAILED DESCRIPTION OF THE EXAMPLE EMBODIMENTS

Figure 1:
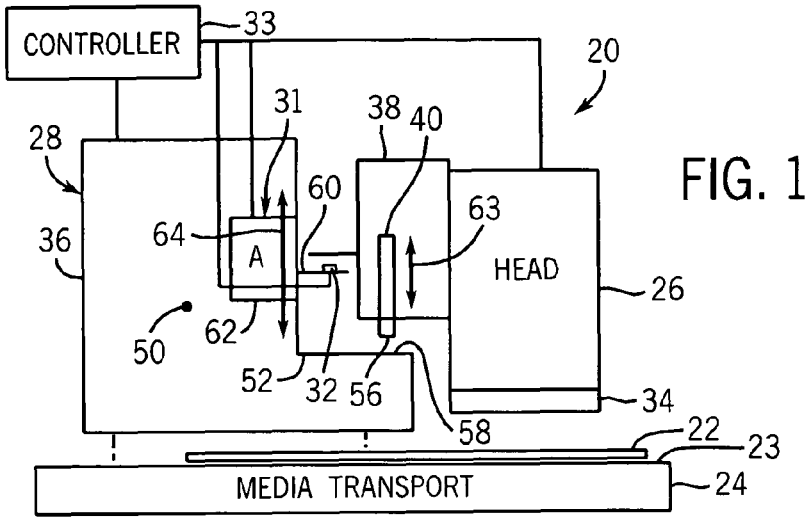
FIG. 1 is a schematic illustration of a printing system according to one exemplary embodiment.

FIG. 1 schematically illustrates a printing system 20 configured to print an image upon print medium 22 such as a sheet of paper or other material. Printing system 20 generally includes media transport 24, imaging head 26, imaging head support 28, elevator 31, sensor 32 and controller 33. Media transport 24 comprises a device configured to transport or move media 22 relative to imaging head 26. In the embodiment shown, media transport 24 is configured to move medium 22 in a generally flat plane along surface 23 relative to support 28. Such movement may be facilitated by one or more belts along surface 23. In other embodiments, media transport 24 may comprise a drum or other mechanisms for moving media relative to imaging head 26.

Imaging head 26 comprises a device configured to print or deposit printing material, such as ink, upon medium 22. In other embodiments the imaging head 26 may be configured to deposit a fluid, such as an adhesive, on the media 22. In one embodiment, imaging head 26 (schematically shown) includes a plurality of fluid ejecting devices, such as printheads 34 through which the printing material is selectively deposited upon medium 22. In other embodiments, imaging head 26 may alternatively include a single printhead.

Imaging head support 28 movably supports imaging head 26 relative to medium 22 and media transport 24. In particular, support 28 facilitates movement of imaging head 26 away from media transport 24 in response to imaging head 26 crashing or otherwise contacting medium 22 such as when medium 22 includes multiple sheets, is abnormally thick or is irregular or bent. As a result, support 28 may reduce damage to printheads 34 while potentially enabling printheads 34 to be more closely spaced with respect to medium 22 for improved print quality.

Imaging head support 28 generally includes base 36, mount 38 and mount positioner 40. Base 36 comprises one or more structures coupled to media transport 24 and configured to movably support mount 38 in the directions indicated by arrows 64. In one embodiment, base 36 extends across media transport 24, allowing media transport 24 to move medium 22 between media transport 24 and base 36. In the particular example illustrated, base 36 is stationarily supported relative to media transport 24, wherein imaging head 26 includes printheads 34 that completely span medium 22 such as with a page-wide array of printheads. In other embodiments, base 36 may alternatively comprise a carriage configured to move along axis 50 so as to also move mount 38 and imaging head 26 across medium 22.

Base 36 includes a platform 52 configured to interact with mount positioner 40 as will be described in greater detail hereafter. In other embodiments, platform 52 may alternatively be provided by one or more surfaces or other structures fixed or at least temporarily retained vertically with respect to surface 23 of media transport 24.

Mount 38 comprises a structure coupled between base 36 and imaging head 26. For purposes of this disclosure, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

Mount 38 is movably coupled to base 36 for movement in the directions indicated by arrows 64. Mount 38 is stationarily coupled to imaging head 26. In the particular example shown, mount 38 is slidably coupled to base 36 and is releasably or removably coupled to imaging head 26. In other embodiments, mount 38 may be movably coupled to base 36 in other fashions and may be permanently coupled or fixed to imaging head 26. In some embodiments, mount 38 may be integrally formed as part of a single unitary body with imaging head 26.

Mount positioner 40 comprises one or more structures coupled to mount 38 and configured to interact with platform 52 of base 36 so as to regulate the positioning of mount 38 with respect to base 36 and to also regulate the positioning of imaging head 26 with respect to surface 23 of media transport 24. Positioner 40 projects from mount 38 and terminates at surface 56 generally opposite to surface 58 provided on platform 52. Surface 56 abuts or engages surface 58 to limit movement of mount 38 towards platform 52 and to limit movement of printhead 34 towards surface 23 of media transport 24. At the same time, surface 56 merely rests upon surface 58, allowing mount 38 to move away from media transport 24 in the event of printheads 34 or other structures associated with imaging head 26 crashing or otherwise contacting medium 22.

In the particular example illustrated, mount positioner 40 is adjustably positioned in the direction indicated by arrows 63 with respect to mount 38. Surface 56 is movable between and configured to be selectively retained in one of a plurality of positions relative to surface 58. In one embodiment, positioner 40 may be screwed to mount 38 such that rotation of positioner 40 adjusts the positioning of surface 56. In another embodiment, one of positioner 40 and mount 38 may include a plurality of spaced detents while the other of positioner 40 and mount 38 includes a detent engaging protuberance, whereby selective positioning of the detent of the protuberance of one of the plurality of detents retains surface 56 in one of a plurality of positions. In still other embodiments, positioner 40 may be adjustably secured to mount 38 in other fashions. In some embodiments, positioner may alternatively be fixed relative to mount 38. Because surface 56 is adjustably positioned relative to surface 58, the spacing between printheads 34 and surface 23 of media transport 24 may also be adjusted to accommodate differing thicknesses of medium 22 or to vary spacing between printheads 34 and medium 22.

Elevator 31 generally comprises a device coupled to base 36 and configured to lift imaging head 26 while also being configured to be decoupled from imaging head 26. In one embodiment, elevator 31 is configured to automatically decouple from imaging head 26 in response to imaging head 26 colliding or otherwise contacting an obstruction such as an abnormally thick or deformed sheet or piece of media. In one embodiment, elevator 31 may also be configured such that imaging head 126 may be separated from elevator 31 without the use of tools, without any cutting or permanent deformation of any components and without unfastening any fasteners. In one embodiment, elevator 31 is configured to facilitate lifting of imaging head 26 for repair, inspection or replacement of imaging head 26.

As shown by FIG. 1, elevator 31 includes lifting surface 60 and actuator 62. Lifting surface 60 is movably coupled to base 36 and is configured to project below a portion of mount 38 such that when lifting surface 60 is raised, lifting surface 60 will contact mount 38 to lift mount 38 and imaging head 26. At the same time, lifting surface 60 enables mount 38 and imaging head 26 to be decoupled from lifting surface 60 by being lifted above lifting surface 60 such as when imaging head 26 contacts an obstruction causing imaging head 26 to rise or such as when imaging head 26 is manually lifted. Lifting surface 60 further contacts a surface of mount 38 to support mount 38 at a desired vertical height or elevation so as to also support imaging head 26 at a predetermined height relative to medium 22.

Actuator 62 comprises a mechanism configured to selectively raise and lower lifting surface 60 in the direction indicated by arrows 64. In one embodiment, actuator 62 is coupled to base 36. In another embodiment, actuator 62 may be supported by other structures. In one embodiment, actuator 62 includes a motor and a transmission configured to convert the torque provided by the motor to linear movement for moving lifting surface 60 in the direction indicated by arrow 64. For example, in one embodiment, actuator 62 may comprise a nut slidably supported for linear movement and threaded to a screw rotatably driven by the motor.

In another embodiment, actuator 62 may comprise a motor operably coupled to a pinion gear connected to a rack gear that is coupled to lifting surface 60. In other embodiments, actuator 62 may comprise a hydraulic or pneumatic piston-cylinder assembly or an electric solenoid. In still other embodiments, other forms of linear actuators may be utilized.

Sensor 32 comprises a sensor coupled to one of mount 38 and lifting surface 60 that is configured to detect contact or engagement of lifting surface 60 with mount 38. In the particular example shown, sensor 32 is coupled to lifting surface 60. Based upon whether lifting surface 60 is in engagement or out of engagement with mount 38, sensor 32 transmits signals to controller 33. In one embodiment, sensor 32 may comprise an optical sensor. In other embodiments, other forms of sensors may be employed.

Controller 33 generally comprises a processing unit in communication with one or more of imaging head 26, actuator 62, and sensor 32. For purposes of this disclosure, the term "processing unit" shall mean a conventionally known or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 33 is not limited to any specific combination of hardware circuitry and software, nor to any particular source for the instructions executed by the processing unit.

In the particular example shown, controller 33 is configured to generate control signals directing the operation of actuator 62 based upon signals received from sensor 32 and based upon input instructions regarding the operation of printing system 20. Such instructions may be manually entered by an operator, may be transmitted to controller 33 by another processing unit, or may be provided by computer readable instructions contained in a permanent or portable memory or other computer readable medium.

In cooperation with one or more of each other, elevator 31, sensor 32 and controller 33 may be used to perform one or more of several potential operations including: (1) automated imaging head height adjustment, (2) positioner setting identification, (3) media thickness detection and system calibration, and (4) crash detection.

In operation, elevator 31 and controller 33 may be used to raise or lower imaging head 26 to a desired height above print medium 22. For example, upon receiving input information selecting a desired height or spacing between imaging head 26 and medium 22, controller 33 generates control signals directing actuator 62 of elevator 31 to raise or lower lifting surface 60 to position imaging head 26 with respect to medium 22. In such a scenario, surface 56 of positioner 40 establishes the closest to media 22 that imaging head 26 may be spaced. At the same time, mount 38 and imaging head 26 may decouple from lifting surface 60 during a collision to avoid damage to imaging head 26 or to avoid pinching of an object between imaging head 26 and media transport 24.

According to one exemplary embodiment, the vertical position of surface 56 of positioner 40 which establishes the lowest extent to which imaging head 26 may be lowered by elevator 31 may be detected. In operation, controller 33 generates control signals directing actuator 62 to lower lifting surface 60 until lifting surface 60 is moved out of contact with mount 38. In particular, during lowering of lifting surface 60, surface 56 of positioner 40 will contact surface 58 of platform 52, preventing further lowering of mount 38. At the same time, the continued lowering of lifting surface 60 will move lifting surface 60 out of engagement with mount 38. In one embodiment, sensor 32 is configured to detect disengagement of lifting surface 60 from mount 38 and to transmit signals at the time of such disengagement to controller 33. Based upon such signals, and the known or detected position of lifting surface 60 at the time such signals are received, controller 33 may calculate the vertical positioning of surface 56.

In another embodiment; sensor 32 may alternatively be configured to transmit signals to controller 33 upon engagement or close proximity of lifting surface 60 and mount 38. In such an embodiment, after lifting surface 60 has been lowered below the opposite portion of mount 38 and decouple from mount 38, controller 33 generates control signals directing actuator 62 to raise lifting surface 60 until lifting surface 60 engages or is brought into close proximity to mount 38 so as to trigger sensor 32. Based upon the known or detected location of lifting surface 60 when controller 33 receives signals from sensor 32 indicating engagement or close proximity of lifting surface 60 and mount 38, controller 33 may calculate the vertical positioning of surface 56 of positioner 40.

According to one embodiment, elevator 31, sensor 32 and controller 33 may cooperate with one another to detect a thickness of media 22 and to calibrate system 20 based upon the detected thickness. In the particular embodiment shown, positioner 40 is vertically repositioned such that imaging head 26 contacts medium 22 prior to surface 56 of positioner 40 contacting surface 58 of platform 52. Such adjustment may be made by an operator in response to written instructions or in response to instructions displayed on an operator interface or display by controller 33 or may be automatically adjusted using an actuator coupled to positioner 40. Once the location of surface 56 of positioner 40 has been adjusted, controller 33 generates control signals directing actuator 62 to lower lifting surface 60 until lifting surface 60 is lowered below and decoupled from mount 38. During lowering of lifting surface 60, imaging head 26 will come to rest upon medium 22, preventing further lowering of imaging head 26. At the same time, actuator 62 will continue to lower lifting surface 60. In one embodiment, sensor 32 may be configured to transmit signals to controller 33 upon decoupling of lifting surface 60 from mount 38. Based upon a detected or otherwise known position of lifting surface 60 (or actuator 62) and the time at which controller 33 receives such signals from sensor 32, controller 33 may calculate the thickness of medium 22.

In another embodiment, controller 33 may additionally generate control signals directing actuator 62 to subsequently raise lifting surface 60 until lifting surface 60 is brought into re-engagement and is recoupled with mount 38. In such an embodiment, sensor 32 may be configured to transmit signals to controller 33 upon the sensed re-engagement or close proximity of lifting surface 60 and mount 38. Based upon the detected or known position of lifting surface 60, at the time signals are received from sensor 32 indicating re-engagement or close proximity of surface 60 and mount 38, controller 33 may calculate the thickness of medium 22.

According to one exemplary embodiment, elevator 31, sensor 32, and controller 33 may also be configured to detect collisions or crashes of imaging head 26 with media 22 or other obstructions. In particular, a collision of imaging head 26 with an underlying obstruction or with medium 22 may result in imaging head 26 rising and mount 38 rising above the established position of lifting surface 60. As a result, mount 38 will disengage lifting surface 60. In such an embodiment, sensor 32 may be configured to transmit signals to controller 33 upon the sensed disengagement of lifting surface 60 and mount 38 or upon lifting surface 60 being separated from mount 38 by a predetermined distance. Upon receiving such signals from sensor 32, controller 33 may identify that a crash or collision has occurred and may generate appropriate control signals for taking appropriate action. For example, controller 33 may generate control signals cessating the operation of imaging head 26 and/or media transport 24.

FIGS. 2-5 illustrates printer system 120, an example embodiment of printer system 20 shown in FIG. 1. Printer system 120 generally includes media transport 124, fluid delivery system 125, imaging head 126, sensor 127 (shown in FIG. 4), imaging head support 128, service station 129, deflector and preload system 130, elevator 131 (shown in FIG. 4), sensor 132 (shown in FIG. 5) and controller 133 (shown in FIG. 2). Media transport 124 moves medium 22 beneath and relative to imaging head 126. In the particular example shown, media transport 124 includes table 200, rollers 202, 204, belts 206 and encoder 208. Table 200 comprises a substantially flat member upon which belts 206 carry medium 22 relative to imaging head 126. In the particular example shown, table 200 also serves as a frame or foundation for support 128.

Rollers 202, 204 comprise cylindrical members rotatably coupled to table 200 on opposite ends of table 200. Rollers 202, 204 are in engagement with belts 206. At least one of rollers 202, 204 is operably coupled to a motor (not shown) so as to be rotatably driven and so as to drive belts 206 along table 200. In other embodiments, rollers 202, 204 may have configurations other than that shown. Moreover, in particular embodiments, roller 202 may be omitted, wherein table 200 has a rounded end configured to permit belts 206 to move about the end of table 200.

Encoder 208 comprises a mechanism coupled to roller 204 configured to sense or detect rotation of roller 204. Encoder 208 generates signals representing the rotation of roller 204 and transmits such signals to controller 133. The signals generated by encoder 208 enable controller 133 to control the rotation of roller 202, 204 and the positioning of medium 22 on belts 206 below imaging head 126.

Belts 206 comprise elongate endless webs extending about table 200 and about rollers 202, 204. Belts 206 are configured to be driven by rotation of one or both of rollers 202, 204. Although media transport 124 is illustrated as including three spaced belts 206, media transport 124 may alternatively include a greater or fewer number of such belts. In still other embodiments, other mechanisms may be used to transport medium 22 such as movable shuttle trays, rollers and the like.

Fluid supply 125 generally comprises a device configured to contain and selectively pump or supply fluid, such as ink, to imaging head 126 through fluid line 210. In other embodiments, other mechanisms may be used to supply fluid to imaging head 126. In still other embodiments, imaging head 126 may alternatively include self-contained fluid reservoirs.

Imaging head 126 comprises a device configured to eject and deposit fluid, such as ink upon medium 22 as medium 22 is moved by media transport 124. In other embodiments, imaging head 126 may alternatively be configured to print on more three-dimensional structures such as packaging, containers or articles. As shown in detail in FIG. 3, imaging head 126 generally includes body 212, imaging head controller 214, fluid manifold 216, printheads 218, and latches 220. Body 212 supports, houses and contains the remaining components of imaging head 126. Body 212 includes an interface 224 configured to be removably mounted to imaging head support 128. Body 212 additionally includes an internal cavity (not shown) which receives imaging head controller 214.

Imaging head controller 214 comprises a processing unit configured to generate control signals for the direction of printheads 218 based upon data received from printing system controller 129 and/or an external computing device (not shown) received through data line 226. In one embodiment, controller 214 includes electronics supported on a printed circuit board (not shown) received within body 212. Controller 214 further transmits and controls distribution of power to printheads 218 received via power line 228.

Fluid manifold 216 distributes fluid, such as ink, received via fluid line 210, to each of printheads 218. Manifold 216 includes internal conduits (not shown) through which ink is distributed to printheads 218. A more detailed description of manifold 216 is found in co-pending U.S. patent application Ser. No. 11/043,519, filed on Jan. 26, 2005, by Perez et al. and entitled FLUID-DELIVERY MECHANISM FOR FLUID-EJECTION DEVICE, the full disclosure of which is hereby incorporated by reference.

Printheads 218 comprise thermoresistive printheads configured to selectively eject fluid, such as ink, through individual nozzles. Each printhead includes a nozzle plate (not shown) including nozzles through which fluid, such as ink, is ejected. In other embodiments, printheads 218 may comprise other forms of printheads such as piezo electric printheads. Although imaging head 126 is illustrated as including five angularly offset and spaced printheads 218, imaging head 126 may alternatively include a greater or fewer number of such printheads.

Figure 3:
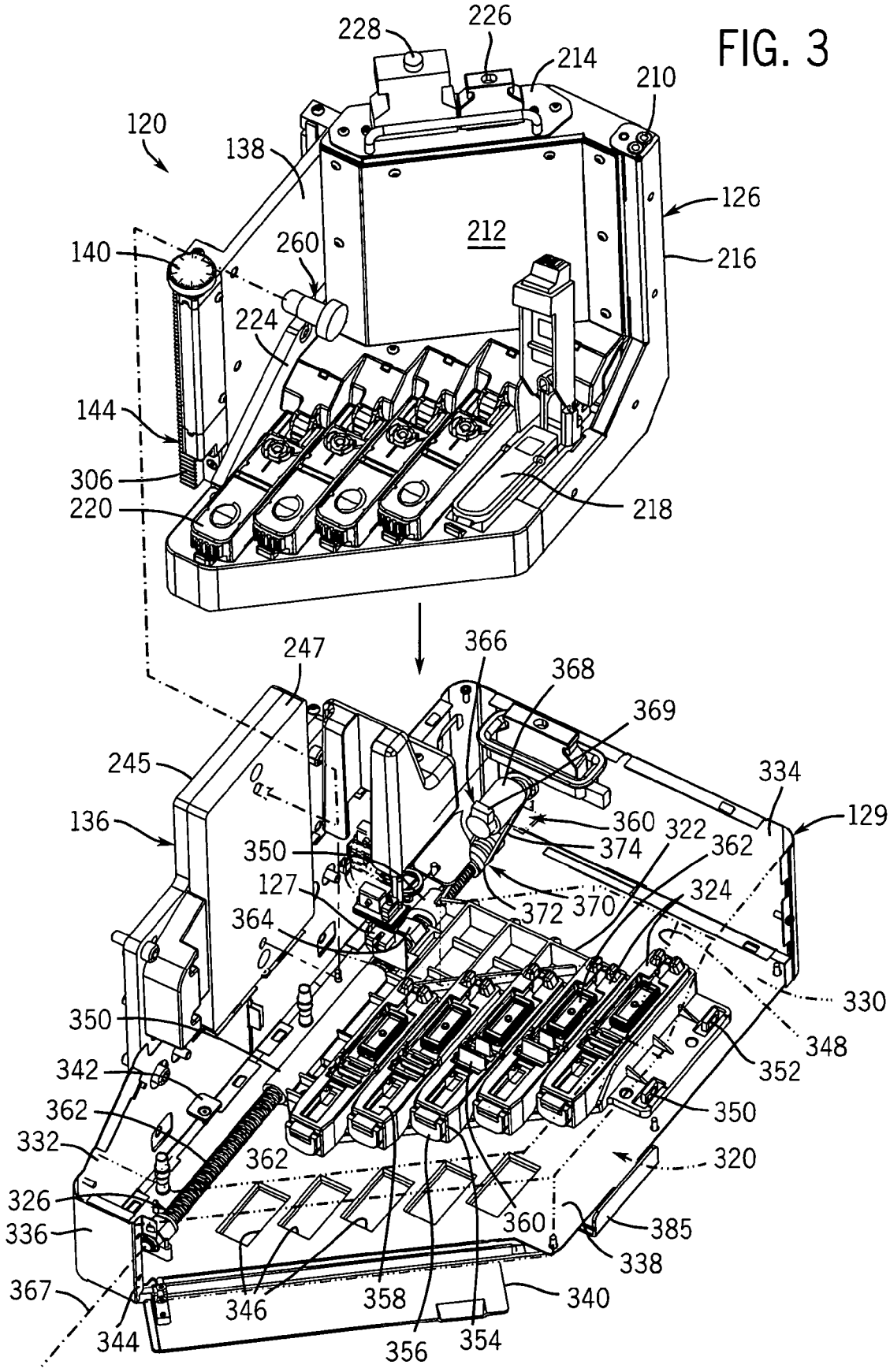
FIG. 3 is an exploded top perspective view of an imaging head and a servicing station of the printing system of FIG. 2 with portions omitted for purposes of illustration according to one exemplary embodiment.

Latches 220 comprise mechanisms configured to releasably retain printheads in place in body 212 and in connection with manifold 216. As shown by FIG. 3, latches 220 pivot between a closed position and an open position, allowing printheads 218 to be withdrawn or inserted. In other embodiments, latches 220 may be omitted where printheads 218 are permanently affixed to or as part of body 212 and/or manifold 216.

Although imaging head 126 is illustrated as utilizing a manifold 216 to distribute ink to printheads 218, imaging head 126 may alternatively distribute fluid or ink to printheads 218 by individual tubes or other fluid delivery structures. Although printheads 218 are illustrated as removably supported by body 212, printheads 218 may alternatively be permanently affixed to body 212 or other structures of imaging head 126. Overall, imaging head 126 may have various other shapes, configurations and components.

Figure 2:
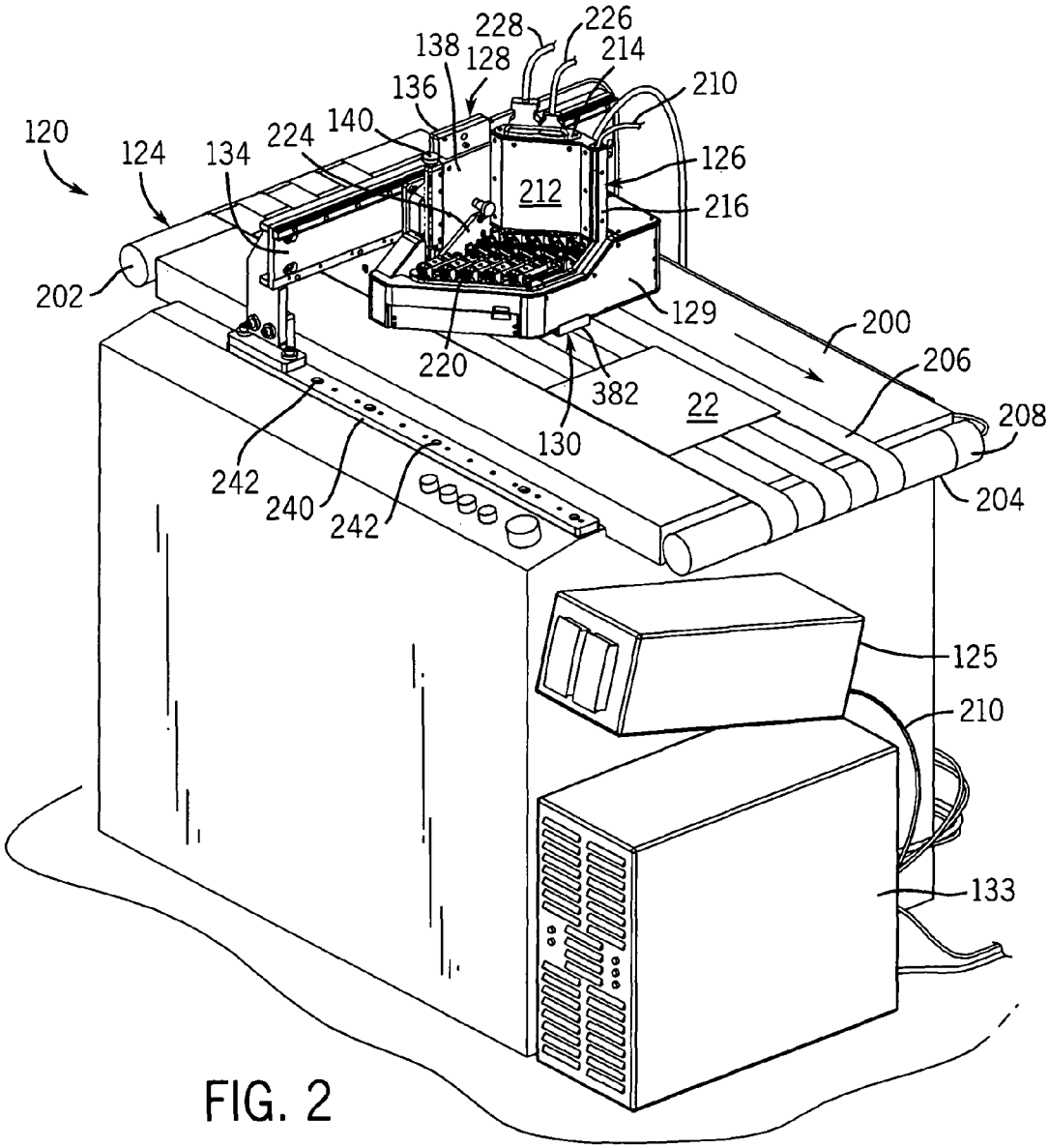
FIG. 2 is a perspective of another embodiment of the printing system of FIG. 1 according to one exemplary embodiment.

Imaging head support 128 movably supports imaging head 126 relative to table 200 and medium 22 being moved by media transport 124. As will be described in greater detail hereafter, imaging head support 128 additionally allows movement of imaging head 126 away from table 200 in response to media collisions to prevent or minimize damage to imaging head 126. As shown in FIG. 2 and illustrated in detail in FIG. 4, support 128 generally includes suspension 134, base 136, mount 138, positioner 140, and unidirectional dampener 144. As shown by FIG. 2, suspension 134 comprises a structure configured to suspend base 136, mount 138 and ultimately imaging head 126 above table 200. In the particular example shown, suspension 134 comprises an elongate beam spanning table 200 and mounted to bracket 240 at one of multiple mounting locations 242 to facilitate repositioning of suspension 134 along table 200 or to enable additional suspensions 134 and their supported imaging heads 126 to be mounted along table 200. In other embodiments, suspension 134 may alternatively include a rod, bar or other structure extending over table 200. In other embodiments, suspension 134 may be additionally configured to movably support base 136, mount 138 and imaging head 126 for movement across table 200.

Base 136 comprises a structure removably mounted to suspension 134 above table 200. In the particular embodiment illustrated, base 136 generally includes back plate 245, intermediate plate 246 and base plate 247. Back plate 245 generally comprises a plate mounted to suspension 134 (shown in FIG. 2). Plate 246 spaces plates 245 and 247 and base plate 247 is mounted to plate 246 and slidably interfaces with mount 238. In the particular example shown, base plate 247 additionally includes detents 252 for selectively retaining mount 138 relative to base 136 at a plurality of positions. In other embodiments, base 136 may have other configurations.

Mount 138 generally comprises a structure coupled between base 136 and imaging head 126 (shown in FIG. 2). Mount 138 is configured to move relative to base 136 in a vertical direction. In the particular embodiment illustrated, mount 138 is removably attached to imaging head 126 by fasteners such as dowel pins 256 configured to extend into corresponding apertures in interface 224 of body 212 of imaging head 126 and screw 257 extending through interface 224 (shown in FIG. 1) into mount 138. In other embodiments, mount 138 may be coupled to imaging head 126 by other fasteners or by permanent welds or bonds. In some embodiments, mount 138 may alternatively be integrally formed as part of a single unitary body with interface 224 or body 212 of imaging head 126.

In the particular example shown, mount 138 is configured to slide in a vertical direction relative to base 136. Mount 138 generally includes carriage 253, bracket 255 and arm 258. Carriage 253 is configured so as to wrap about base plate 247 to slidably couple mount 138 to base 136. Bracket 255 is mounted to carriage 253 and is configured to support positioner 140. Arm 258 extends from mount 138 and includes a surface 259 configured to interact with elevator 131.

In the particular example illustrated, mount 138 additionally includes lock 260. Lock 260 comprises a pin or other projection configured to be removably inserted into one of detents 252 along base plate 247 to releasably retain mount 138 in one of a plurality of positions with respect to base 136. One example of lock 260 may be found in co-pending U.S. patent application Ser. No. 11/105,696, filed on the same date herewith, by Antoni S. Murcia, Adam Livingston, Dave Berardelli and entitled IMAGING HEAD MOUNT, the full disclosure of which is hereby incorporated by reference.

According to one exemplary embodiment, base plate 247 and carriage 253 comprise a linear slide such as those commercially available from Del-Tron Precision, Inc., of Bethel, Conn., wherein carriage 253 is slidably coupled to base plate 247 by ball bearings. In other embodiments, mount 138 may have other configurations and may be slidably or otherwise movably coupled to base 136 by other mechanisms or slow-friction interfaces.

Positioner 140 comprises a structure coupled to mount 138 and configured to interact with platform 342 of service station 129 to position mount 138 and imaging head 126 (shown in FIG. 1) relative to table 200 (shown in FIG. 2). In the particular example shown, positioner 140 generally includes shaft 280 and knob 282. Shaft 280 extends through portions 266 and 268 of bracket 255 of mount 138. Shaft 280 includes a threaded portion 284, a knurled portion 286 and tip 288. Threaded portion 284 engages corresponding threads in lower portion 268 of bracket 255 such that rotation of shaft 280 moves tip 288 relative to platform 342. The positioning of tip 288 relative to platform 152 establishes a minimum spacing between imaging head 126 and table 200. At the same time, however, because tip 288 merely rests upon platform 342, positioner 140 enables imaging head 126 (shown in FIG. 1) and mount 138 to be lifted off of platform 342 in response to a collision with medium 22.

Knurled portion 286 comprises a roughened area configured to interact with a resiliently flexible projection 269 of bracket 255 to inhibit unintended rotation of shaft 280. In the particular example shown, knurled portion 286 includes a plurality of axial serrations or grooves and engaged by projection 269. In other embodiments, projection 269 may be rigid while knurled portion 286 is resiliently flexible. In other embodiments, other means may be used to inhibit unintentional rotation of shaft 280 and to maintain tip 288 in an established position with respect to platform 342.

Knob 282 is fixed to shaft 280 and is configured to facilitate manual rotation of shaft 280 to reposition tip 288 with respect to platform 152. In the particular example shown, knob 282 includes radial index marks 290 which indicate linear movement of tip 288 brought about by angular rotation of knob 282. In other embodiments, other structures may be provided for facilitating manual rotation of shaft 280.

Uni-directional dampener 144 slows down the free fall motion of imaging head 126 while providing little resistance to upward motion of imaging head 126. Uni-directional dampener 144 includes rack gear 306 and uni-directional rotary dampener 308. Rack gear 306 is coupled to mount 138. Uni-directional rotary dampener 308 includes a pinion gear 310 in meshing engagement with rack gear 306. Rotary dampener 308 resists upward movement of mount 138 by a first degree and resists downward movement of mount 138 and imaging head 126 by a second greater degree. In one embodiment, uni-directional rotary dampener 308 comprises a clockwise rotary damper, 5 N*cm, part number: RN-D2-R501-G1 sold by Ace Controls. In other embodiments, uni-directional dampener 144 may comprise other structures. For example, in another embodiment, rack 306 may alternatively be coupled to base 136 while unidirectional rotary dampener 308 is coupled to mount 138. In other embodiments, other mechanisms may be used to slow descent speed of mount 138 and imaging head 126.

Service station 129 is configured to service printheads 218 (shown in FIG. 3) of imaging head 126. As shown by FIG. 2, service station 129 is coupled to and supported by suspension 134 above table 200. In the particular example shown, service station 129 is directly coupled to back plate 245 of base 136 and is configured to nestingly receive image head 126.

FIG. 3 illustrates service station 129 in detail. As shown by FIG. 3, service station 129 includes chassis 320, carriage 322, service units 324 and carriage actuator 326. Chassis 320 (shown in full in FIG. 10) generally comprises one or more structures configured to support, house and contain the remaining elements of service station 129. Chassis 320 is mounted to back plate 245 of base 136. In other embodiments, chassis 320 may be integrally formed, welded to or bonded to base 136.

Chassis 320 generally includes sidewalls 330, 332, rear storage compartment 334, front wall 336, floor 338, servicing unit removal door 340 and platform 342. Sidewall 330 houses various structures associated with carriage 322. Sidewall 332 is mounted to back plate 245 of base 136 while housing portions of carriage actuator 326. Storage compartment 334 extends at a rear of chassis 320 and includes multiple panels forming a compartment configured to receive carriage 322 and printhead service unit 324 when retracted as shown in FIG. 3. Front wall 336 extends generally opposite to rear storage compartment 334 and includes an opening 344 through which printhead service units 324 may be withdrawn from chassis 320. Floor 338 extends between walls 330, 332, 334 and 336 and includes openings 346 through which printheads 218 extend when depositing fluids, such as ink, upon medium 22. Overall, walls 330, 332, 334, 336 and floor 338 form a cavity 348 into which imaging head 126 may be lowered and nested during printing. Although chassis 320 is illustrated as having a generally rectangular shape with an angled front wall 336, chassis 320 may have other shapes and configurations.

Platform 342 is a generally horizontal surface configured to interact with positioner 140 of image head support 128 to regulate the extent to which imaging head 126 may be lowered by elevator 231 with respect to table 200 (as discussed above with respect to positioner 140). Chassis 320 additionally houses and surrounds rotary dampener 308 described above.

Figure 10:
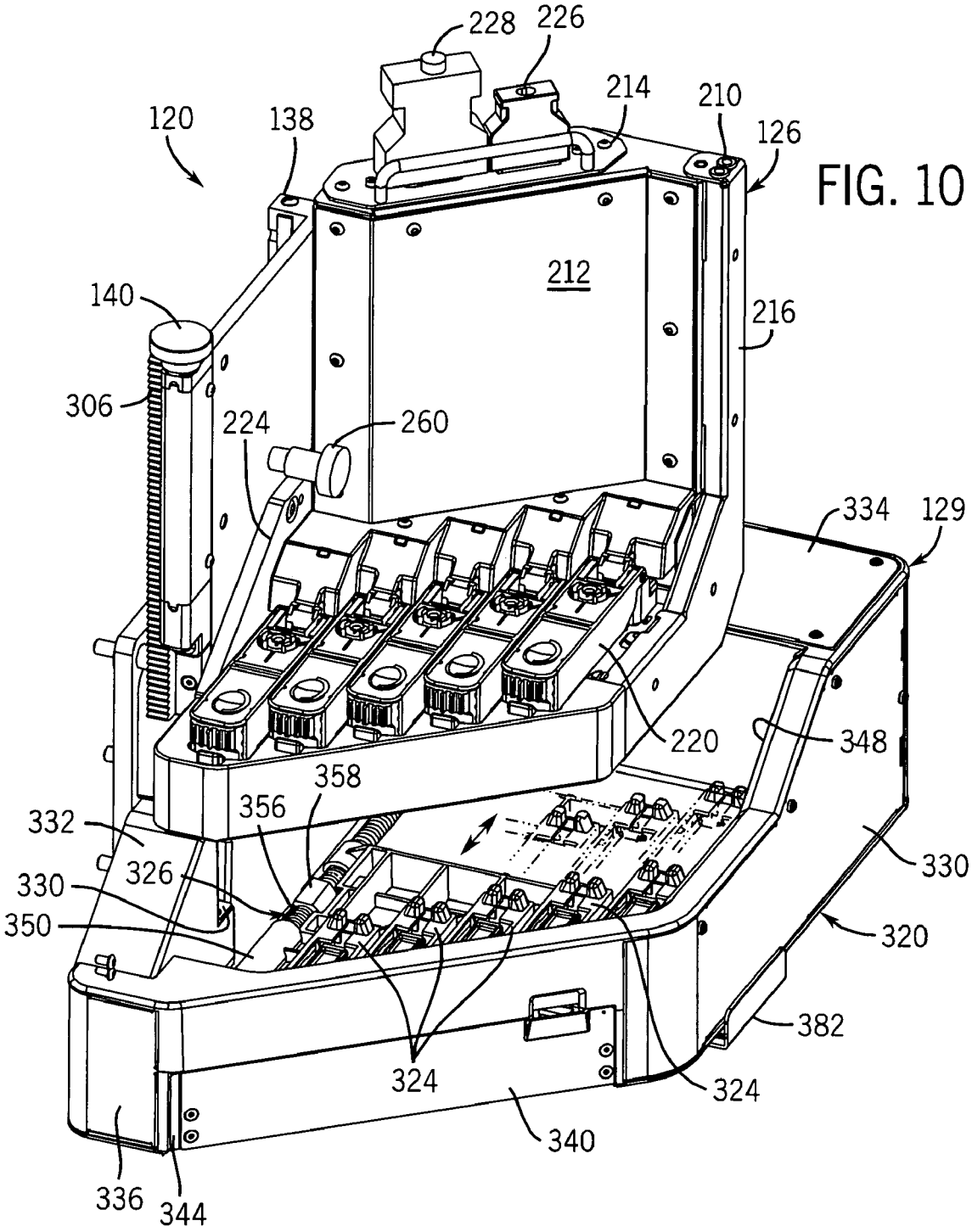
FIG. 10 is a top perspective view of the printing system of FIG. 9 further illustrating actuation of printhead servicing units to an extended position according to one exemplary embodiment.

Printhead servicing unit removal door 340 generally comprises a door between an open position (shown in FIG. 3) and a closed position (shown in FIG. 10). In the opening position, door 340 enables printhead servicing units 324 to be pulled and withdrawn from chassis 320 through opening 340 for servicing, repair or replacement while imaging head 126 substantially remains in place over unit 324. In other embodiments, door 340 may alternatively be slidable between an open and closed position or may be removably fastened to a remainder of chassis 320 so as to be completely removed from chassis 320.

Carriage 322 generally comprises a structure configured to movably support and removably retain printhead service units 324. In the particular example shown, carriage 322 slides within chassis 320 between a retracted position shown in FIG. 3 and an extended position shown in FIGS. 7 and 10. In the retracted position, carriage 322 supports units 324 and a rear of chassis 322 substantially within storage chamber 334, exposing openings 346 and enabling imaging head 126 to be lowered to a printing position in which printheads 218 are aligned with and extend through openings 346.

In the extended position, carriage 322 supports servicing units 324 in position substantially aligned with printheads 218 below printheads 218 to facilitate servicing of printheads 218. Alternatively, in the extended position shown in FIG. 10, carriage 322 positions printhead servicing units 324 for removal through door 340 for repair or replacement. As shown by FIG. 3, in the example shown, carriage 322 is supported on one side by carriage actuator 326 and on an opposite side by Z-bushings 350, 352 which interact with floor 338 of chassis 320 to guide movement of carriage 322.

Printhead servicing units 324 comprise individual units configured to perform one or more servicing operations upon printheads 218. In the particular example shown, each servicing unit 324 includes a body 354, a handle 356, a spittoon 358, a wiper 360 and a capper 362. Body 354 houses and contains the remaining component of each unit 324. Although not shown, body 354 includes latching and datum surfaces which interact with the corresponding surfaces provided on carriage 322 to facilitate proper positioning of unit 324 in carriage 322. Handle 356 projects from an end of body 354 and is configured to facilitate grasping of an individual servicing unit 324 for removal from carriage 322 and for removal through opening 344 for replacement, servicing or repair. Spittoon 358 comprises an opening configured to receive fluid, such as ink, spit by a corresponding printhead 218. Wiper 360 comprises a generally flexible elastomeric blade configured to wipe printhead 218. Capper 360 comprises a mechanism configured to cap and de-cap nozzles associated with printhead 218. Although printhead servicing unit 324 are illustrated as providing spitting, wiping and capping functions, printhead servicing units 324 may provide a fewer or greater of such servicing operations. Although printhead servicing units 324 are illustrated as being removably coupled to carriage 322, units 324 may alternatively be fixedly coupled or integrally formed as part of a single unitary body with carriage 322. In some embodiments, carriage 322 and printhead servicing units 324 may be configured to be simultaneously removed through opening 344 from chassis 320.

Carriage actuator 326 comprises a mechanism configured to actuate or move carriage 322 and units 324 between the retracted and the extended positions. In the particular example illustrated, carriage actuator 326 generally includes lead screw 362, nut 364, and rotary actuator 366. Lead screw 362 comprises an elongate threaded member rotatably supported within chassis 320, operably coupled to carriage 322 and configured to be rotated by rotary actuator 366 to move carriage 322 between the extended and retracted positions upon being rotated. Nut 364 comprises a threaded member fixed or otherwise held against rotation and configured to move along axis 367 of lead screw 362 in response to rotation of lead screw 362 so as to also move carriage 322 along axis 367. In the particular example shown, carriage 322 is shaped and configured so as to abut nut 364 to prevent rotation of nut 364. At the same time, nut 364 is axially captured between sleeves 350 of carriage 322 such that nut 364 engages one of sleeves 350 to move carriage 322. In other embodiments, nut 364 may be fixed to carriage 322 or may be integrally formed as part of a single unitary body with carriage 322. In particular embodiments, nut 364 may be omitted where one or both of sleeves 350 includes internal threads engaging the external threads of lead screw 362.

Rotary actuator 366 comprises a mechanism configured to rotate lead screw 362 so as to selectively move carriage 322 along axis 367 and between the extended and retracted positions. In the particular example shown, rotary actuator 366 includes motor 368, encoder 369, and transmission 370. Motor 368 supplies torque which is transmitted by transmission 370 to lead screw 362 to rotate lead screw 362. Encoder 369 is coupled to motor 368 and communicates signals to controller 133 (shown in FIG. 2) indicating the degree of rotation of an output shaft of motor 368 enabling controller 133 to determine and control the positioning of carriage 322 and units 324 along axis 367. In other embodiments, encoder 369 may be omitted where motor 368 or other structures are utilized to communicate signals to controller 133 representing rotation of lead screw 362 or rotation of the output shaft of motor 368. In still other embodiments, other sensors may be used to determine and communicate to controller 133 the positioning of carriage 322 and units 324 along axis 367.

Transmission 370 transmits torque from motor 368 to lead screw 362 so as to rotate lead screw 362. In the particular example shown, transmission 370 includes pulley 372 coupled to lead screw 362 and belt 374 extending between pulley 372 and an output shaft of motor 368. In other embodiments, transmission 370 may have other configurations such as a chain and sprocket arrangement, a series of gears and the like.

Deflector and preload system 130 (shown in detail in FIG. 6) exerts an upward force to imaging head 126, countering the weight of imaging head 126. As a result, less force and collision from a medium and imaging head 126 will lift imaging head 126 away from the medium 22. System 130 includes preload mechanism 380 and deflector 382. Preload mechanism 380 includes base 385, shafts 387 and springs 389. Base 385 comprises an elongate member removably coupled to imaging head 126, facilitating the replacement or exchange of deflector 382 and preload mechanism 380. In the particular embodiment illustrated, base 385 comprises a plate coupled to chassis 320. In other embodiments, base 385 may be integrally formed as part of a single unitary body with chassis 320.

Shafts 387 comprise elongate members slidably passing through base 385. Shafts 387 each have a lower end 390 fixed to deflector 382 and an opposite upper end terminating at a head 391. Springs 389 comprise compression springs extending about shafts 387 and captured between base 385 and head 391. When compressed, springs 389 apply a force to head 391, biasing head 391, shaft 387 and deflector 382 in an upward direction away from table 200.

Deflector 382 comprises a structure configured to protect nozzle plates (not shown) of printheads 218 from any media passing between table 200 and printheads 218. Deflector 382 is fixed to shafts 387 and includes a ramp (not shown) and bottom 396. The ramp comprises a sloped or beveled surface facing the direction in which media is supplied to imaging head 126 and is configured to funnel or direct bent media downward towards table 200 to minimize scratching of the nozzle plates.

Bottom 396 extends from ramp beneath printheads 218 of imaging head 126. Bottom 396 is configured so as to generally extend parallel to table 200 and includes openings 397 through which printheads 218 eject ink onto media being carried by table 200. In one particular embodiment, bottom 396 includes upwardly extending recesses about printheads 218, further spacing printheads 218 from table 200.

Figure 6:
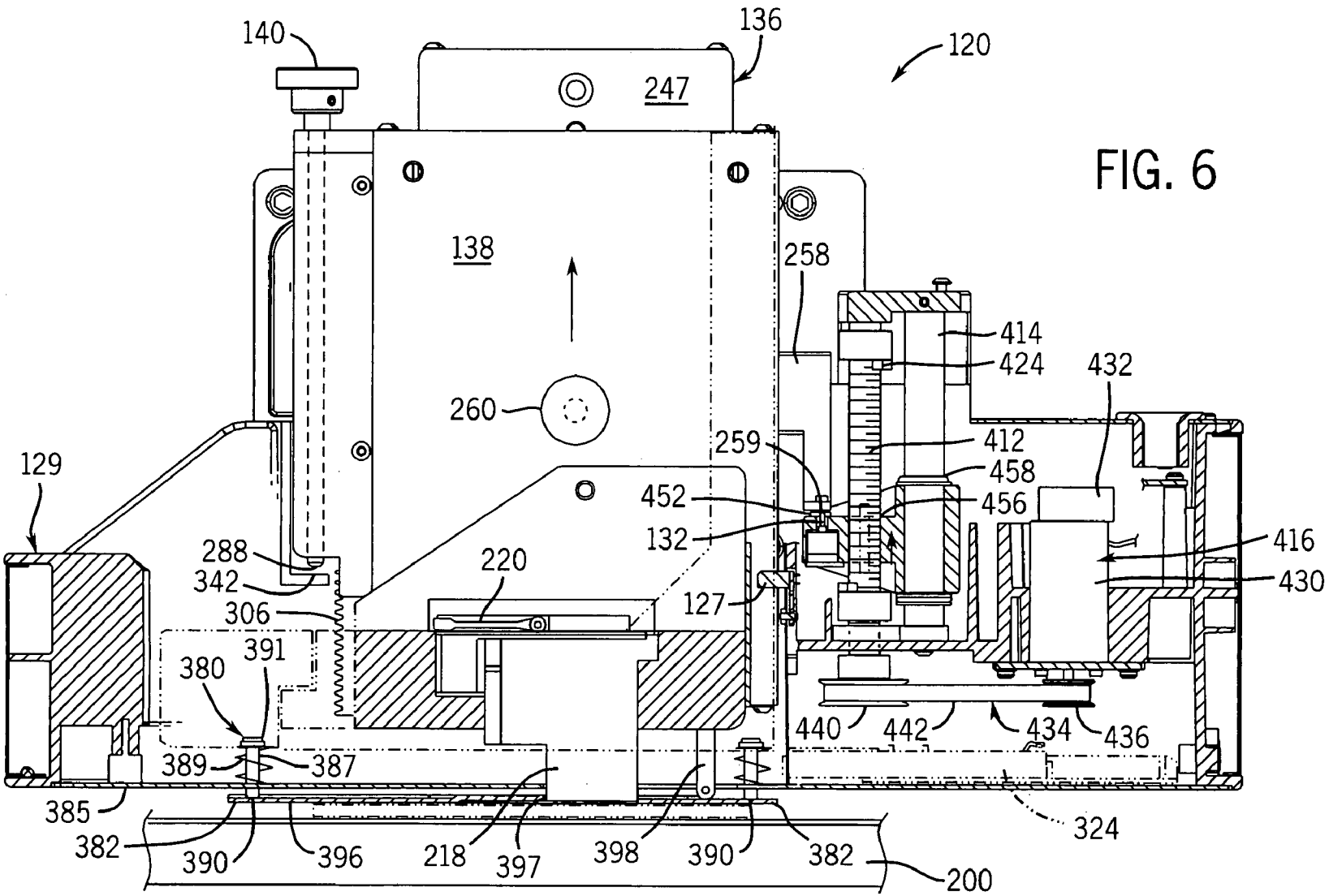
FIG. 6 is a fragmentary sectional view of the printing system of FIG. 2 illustrating the imaging head supported by the elevator in a printing position according to one exemplary embodiment.

As shown by FIG. 6, deflector 382 is engaged by projections or legs 398 projecting from a lower end of imaging head 126 to a point below base 385. Legs 398 space bottom 396 of deflector 382 from base 385 and define the location of deflector 382 with respect to printheads 218. The spacing of deflector 382 from base 385 also results in spring 389 being compressed and spring 389 exerting an opposite lifting force to imaging head 126 through shaft 387, deflector 382 and legs 398. Although imaging head 126 is shown as additionally including three projections or legs 398, in other embodiments, imaging head 126 may additionally include a greater or fewer number of such legs.

Figures 4, 5:
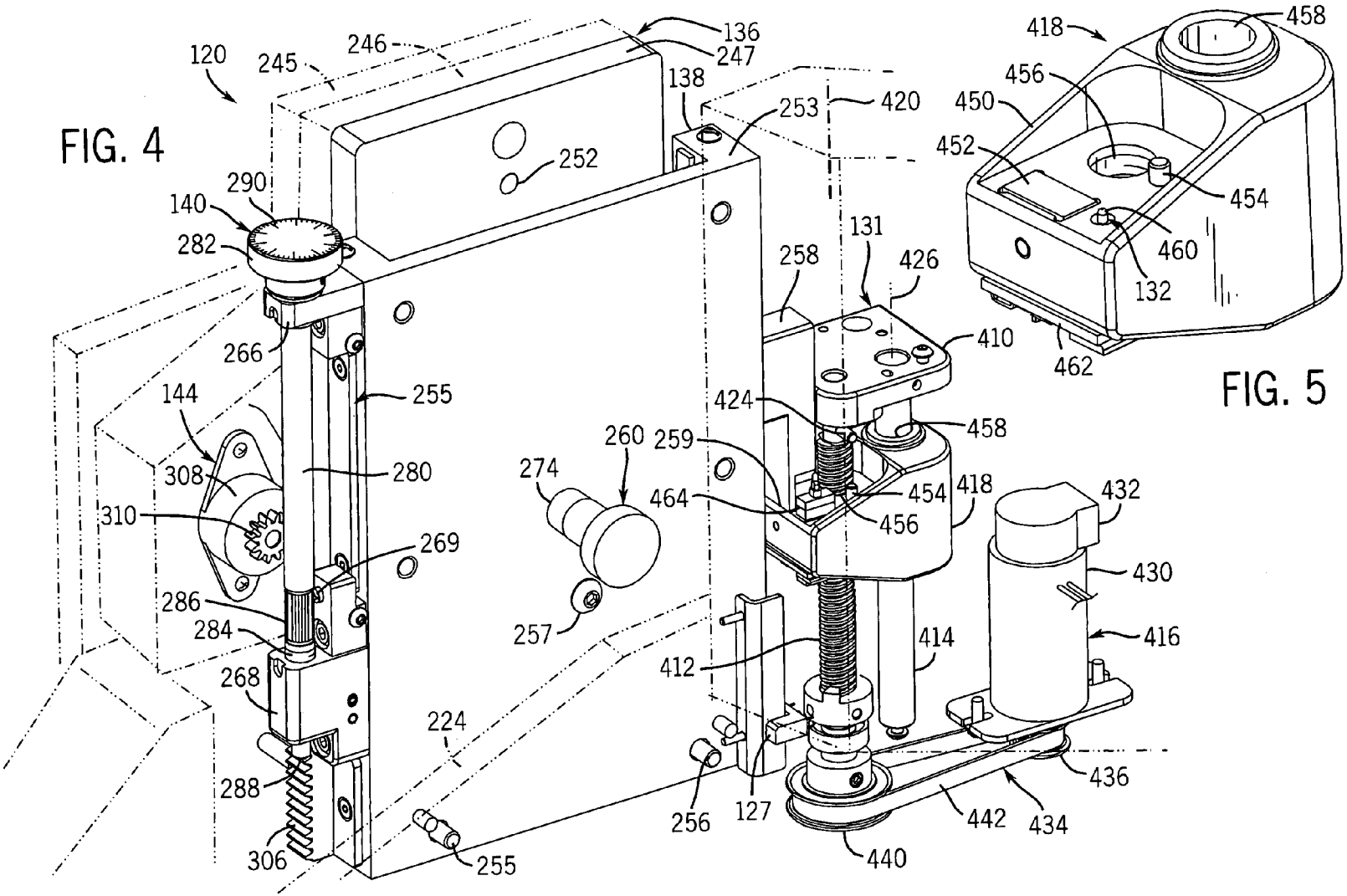
FIG. 4 is a fragmentary perspective view of an elevator and imaging head support of the printing system of FIG. 2 according to one exemplary embodiment.
FIG. 5 is a top perspective view of a nut of the elevator of FIG. 4 according to one exemplary embodiment.

As shown in FIGS. 4 and 5, elevator 131 includes bearing block 410, screw 412, guide 414 and rotary actuator 416. Bearing block 410 generally comprises a structure configured to rotatably support screw 412. Bearing block 410 further supports guide 414. In the example shown, bearing block 410 is mounted to chassis 320 of service station 129 (shown in FIG. 3). In other embodiments, bearing block 410 may be mounted to suspension 134 or base 136. In still other embodiments, bearing block 410 may be integrally formed as part of a single unitary body with chassis 320, suspension 134 or base 136.

Screw 412 generally comprises an elongate threaded shaft extending along axis 420 and rotatably supported by bearing block 410 for rotation about axis 420. Screw 412 configured to be rotated about axis 420 by rotary actuator 416 while threadably engaging nut 418. In the particular example shown, screw 412 additionally includes the projection 424 configured to interact with nut 418 when nut 418 is proximate to or has reached an upper limit of travel.

Guide 414 comprises an elongate shaft or other structure configured to prevent rotation of nut 418 about axis 420 while allowing nut 418 to move along axis 420. In the particular example shown, guide 414 comprises an elongate shaft extending along an axis 426 and slidably passing through nut 418. In other embodiments, guide 414 may be coupled or supported by other structures other than bearing block 410 and may interact with nut 418 in other fashions. For example, in other embodiments, guide 414 may comprise an elongate tongue received within a corresponding channel provided in nut 418. In still other embodiments, guide 414 may comprise an elongate channel receiving a corresponding projection or tongue extending from nut 418.

Rotary actuator 416 comprises a mechanism configured to rotatably drive screw 412 about axis 420 to move nut 418 along axis 420. In the particular example shown, rotary actuator 416 generally includes motor 430, encoder 432 and transmission 434. Motor 430 comprises a source of torque rotatably driving screw 412. In the particular example shown, motor 430 comprises a direct current (DC) motor having an output shaft 436 and operably coupled to encoder 432. In other embodiments, other forms of motors may be used to supply torque.

Encoder 432 comprises a sensing device configured to detect rotation of output shaft 436 and to transmit signals representing such rotation to controller 133 (shown in FIG. 2). As a result, based upon such signals, controller 133 may calculate and control the positioning of nut 418 along axis 420. In other embodiments, rotary actuator 416 may utilize other devices for sensing rotation of output shaft 436. In still other embodiments, other sensors may be used for alternatively detecting rotation of lead screw 412 or for detecting the positioning of nut 418 along axis 420.

Transmission 434 comprises an arrangement configured to transmit torque from output shaft 436 of motor 430 to lead screw 412. In the particular example shown, transmission 434 includes a pulley 440 secured to screw 412 and a belt 442 wrapped out output shaft 436 and pulley 440. In other embodiments, transmission 434 may have other configurations. For example, transmission 434 may alternatively comprise a chain and sprocket arrangement, a series of gears extending between output shaft 436 and lead screw 412 or other such devices.

Nut 418 comprises a structure configured to linearly move along axis 420 in response to rotation of screw 412. As shown in detail in FIG. 5, nut 418 generally includes body 450, lift surface 452 and stop 454. Body 450 houses and supports sensor 132, lift surface 452 and stop 454. Body 450 includes a threaded bore 456 through which screw 412 extends and an unthreaded bore 458 through which guide 414 extends. In lieu of the shape shown, nut 418 may also have other shapes and configurations.

Lift surface 452 extends along body 450 and is configured to engage surface 259 of arm 258 to support mount 138 and imaging head 126 (shown in FIG. 2) at a height along axis 420. Lift surface 452 further engages surface 259 of arm 258 as rotary actuator 416 is moving nut 418 along axis 420 to raise or lower mount 138 and imaging head 126. In the particular example shown, lifting surface 452 is provided by a separate magnetic member affixed to body 450, wherein end 259 of arm 258 is formed from a ferrous material, is proximate a ferrous material, is formed from a magnetic material having opposite polarity as surface 452 or is proximate a magnetic material having an opposite polarity as surface 452 such that surfaces 259 and 452 are magnetically attracted towards one another. The magnetic attraction between surfaces 259 and 452 retains surface 259 against surface 452 during vibration to facilitate consistent positioning of imaging head 126 with respect to medium 22.

In other embodiments, surface 452 may be ferrous while surface 259 of arm 258 is magnetic or is proximate to a magnetic member. In other embodiments, surface 452 may be integrally formed as part of a single unitary body with body 450 while being magnetic or ferrous in nature. In still other embodiments, surfaces 259 and 452 may not be magnetically attracted to one another.

Stop 454 comprises a projection extending from body 450 configured to engage projection 424 as nut 450 approaches or reaches its upper limit of travel along screw 412 and along axis 420. In particular, when stop 454 engages stop 424 of screw 412, encoder 432 detects a sudden increase in position error and cessates the application of torque to screw 412. Encoder 432 further resets or calibrates itself to a "zero absolute" position which corresponds to the positioning of nut 418 along screw 412 at which stop 454 engages stop 424 of screw 412. In other embodiments, projection 454 may be omitted or other mechanisms may be used to detect an end of travel of nut 418 along screw 412.

Sensor 132 comprises a device configured to sense the proximity or engagement of surface 259 of arm 258 and lift surface 452 of nut 418. Sensor 132 includes a projecting pin 460 projecting slightly above surface 452 and a printed circuit assembly 462 secured to body 450 of nut 418. Upon being depressed by portion 464 of arm 258, sensor 132 transmits signals to controller 133 for use in controlling the operation of imaging head 126, service station 129 and elevator 131.

Controller 133 (shown in FIG. 2) comprises one or more processing units (and associated memory) configured to generate control signals to direct the operation of components of printer system 120 including printhead controller 214, media transport 124, fluid supply 125, rotary actuator 366, service station 129 and rotary actuator 416 of elevator 131. Controller 133 generates such control signals based upon information received from sensors, such as sensor 127 and 131, as well as input instructions from an operator or another computing device. In the particular example shown, controller 133 is configured (1) to generate control signals directing rotary actuator 416 to raise and lower imaging head 126 to a desired spacing from media 22 (shown in FIG. 2) and to maintain imaging head 126 at such spacing until a collision or crash occurs, (2) to generate control signals directing the operation of rotary actuator 416 and rotary actuator 366 for appropriately positioning printheads 218 of imaging head 126 relative to printhead servicing units 324 for servicing of printheads 218, (3) to cessate the operation of one or more actuators and moving components of printing system 120 based upon signals from sensor 127, (4) to generate control signals directing actuator 416 to move nut 418 to determine the existing setting of positioner 40 establishing the lowest point at which imaging head 126 may be lowered with respect to media 22 based upon signals from sensor 132, (5) to generate control signals directing rotary actuator 416 to appropriately raise and/or lower nut 450 below imaging head 126 to determine a thickness of media 22 based upon signals from sensor 132 and to calibrate system 120 based upon the detected thickness, and (6) to generate control signals either stopping the operation of one or more components of printing system 120 or providing notice of a crash in response to receiving signals from sensor 132.

FIG. 6 illustrates rotary actuator 416 rotating screw 412 to raise nut 418 while in engagement with arm 258 to lift mount 138 and imaging head 126 to a desired spacing with respect to media 22 in response to control signals from controller 133 (shown in FIG. 2). Once attaining a desired spacing between printheads 118 and media 22, rotary actuator 416 cessates its supply of torque to screw 412 such that arm 258 rests upon nut 418 during subsequent printing by image head 126. In the particular example shown, surface 459 of arm 258 is magnetically attracted to surface 452 to maintain contact between surfaces 259 and 452 so as to maintain positioning of imaging head 126 during acceptable levels of force such as minor vibration.

Figure 7:
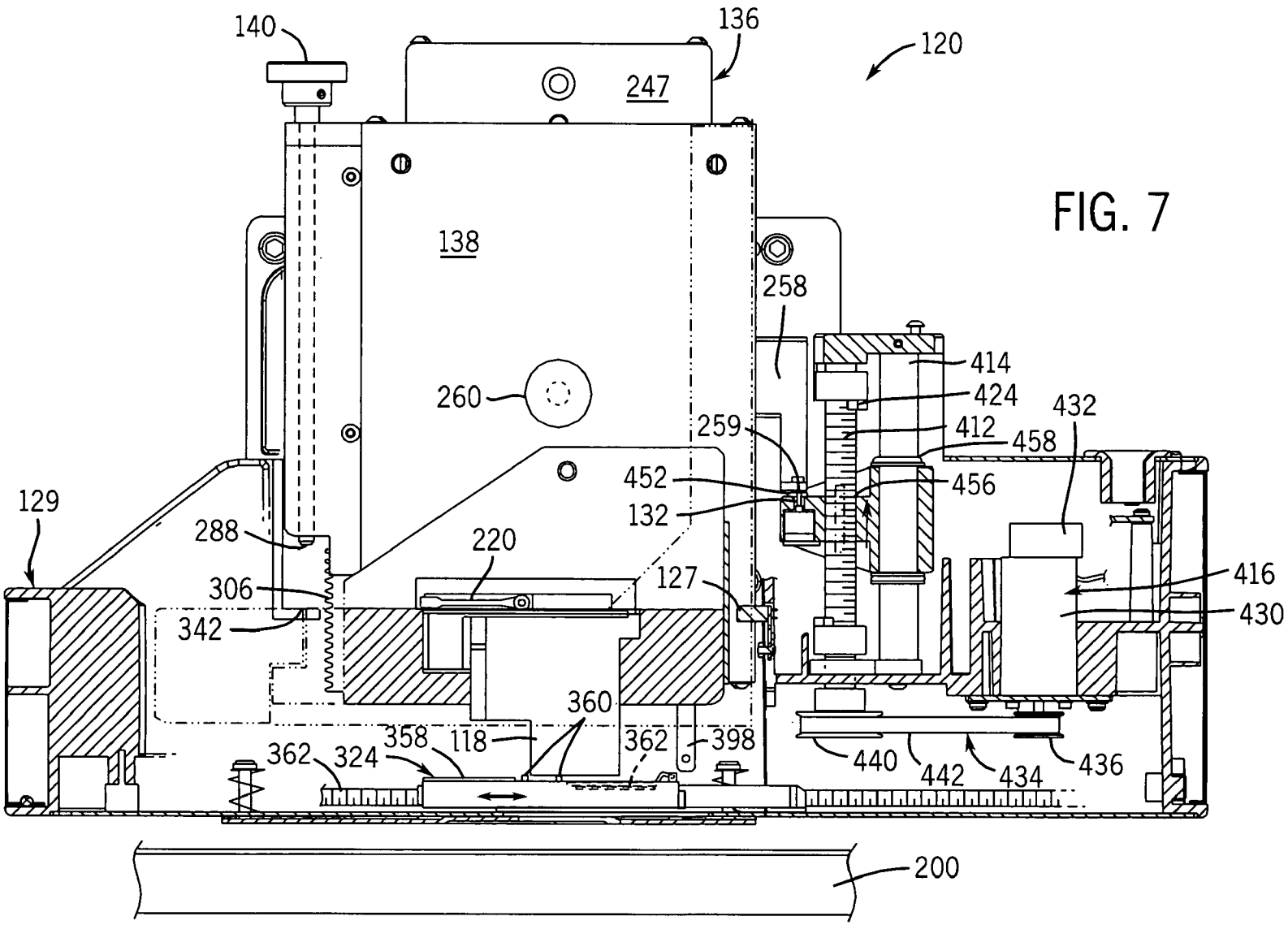
FIG. 7 is a fragmentary sectional view of the printing system of FIG. 2 illustrating the elevator supporting the imaging head opposite a servicing system in an extended position according to one exemplary embodiment.

FIG. 7 illustrates rotary actuator 416 actuated in response to control signals from controller 133 (shown in FIG. 2) to position imaging head 126 and its printheads 118 at a servicing height. To service printheads 118, rotary actuator 416 rotatably drives screw 412 so as to lift nut 418 and so as to correspondingly lift imaging head 126 and its printheads 118 to a position elevated at a height greater than a height of printhead servicing units 324. Thereafter, controller 133 (shown in FIG. 2) generates control signals directing rotary actuator 366 (shown in FIG. 3) to rotate screw 362 so as to linearly move carriage 322 and printhead servicing unit 324 from the retracted position shown in FIG. 3 to the extended position shown in FIGS. 7 and 10. After printhead servicing units 324 are positioned in alignment with printheads 118 as detected by encoder 369, controller 133 generates control signals directing rotary actuator 416 to rotate lead screw 412 so as to lower imaging head 126 and its printheads 118 into proximity with printhead servicing units 324 as shown in FIG. 7. In particular, nozzles of printheads 118 may be cleared by rotary actuator 316 positioning spittoons 358 opposite to such nozzles and printheads 118 being actuated to spit fluid, such as ink, into spittoons 358. Nozzle plates of printheads 118 may be cleaned by rotary actuator 366 moving printhead servicing units 324 with printheads 118 lowered by elevator 131 into contact with wipers 360. The nozzles of printheads 118 may be capped by rotary actuator 366 aligning cappers 362 with respect to such nozzles and by elevator 131 lowering printheads 118 into capping positions with respect to cappers 362. When servicing is complete, elevator 131 raises printheads 118 and rotary actuator 366 actuates carriage 322 and printhead servicing units 324 once again to the retracted position shown in FIGS. 3 and 8.

Figure 8:
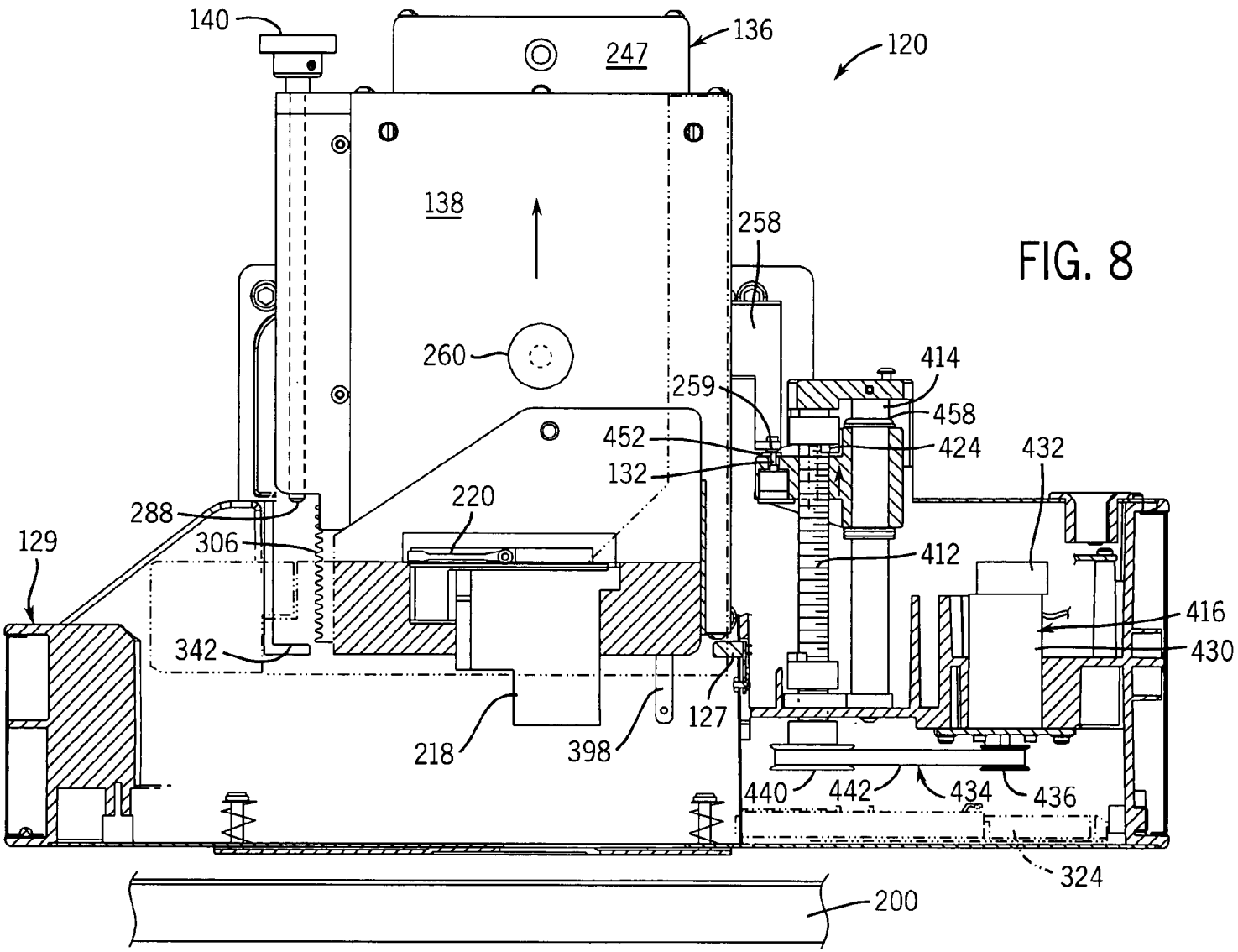
FIG. 8 is a fragmentary sectional view of the printing system of FIG. 2 illustrating the elevator supporting the imaging head at an elevated position according to one exemplary embodiment.

FIG. 8 illustrates the operation of sensor 127. In particular, FIG. 8 illustrates imaging head 126 after being lifted by elevator 131 to a position just clearing sensor 127. As noted above, sensor 127 is mounted to chassis 320 such that imaging head 126 clears sensor 127 just prior to nut 418 reaching its end of travel along screw 412. Sensor 127 is also located such that imaging head 126 (or a flag coupled to imaging head 126) clears sensor 127 prior to imaging head 126 reaching an elevation sufficient to expose moving parts such as moving parts of service station 129 or moving parts of elevator 131. The position of imaging head 126 at which imaging head 126 clears sensor 127 is recorded by controller 133 (shown in FIG. 2) in its associated memory.

Figure 9:
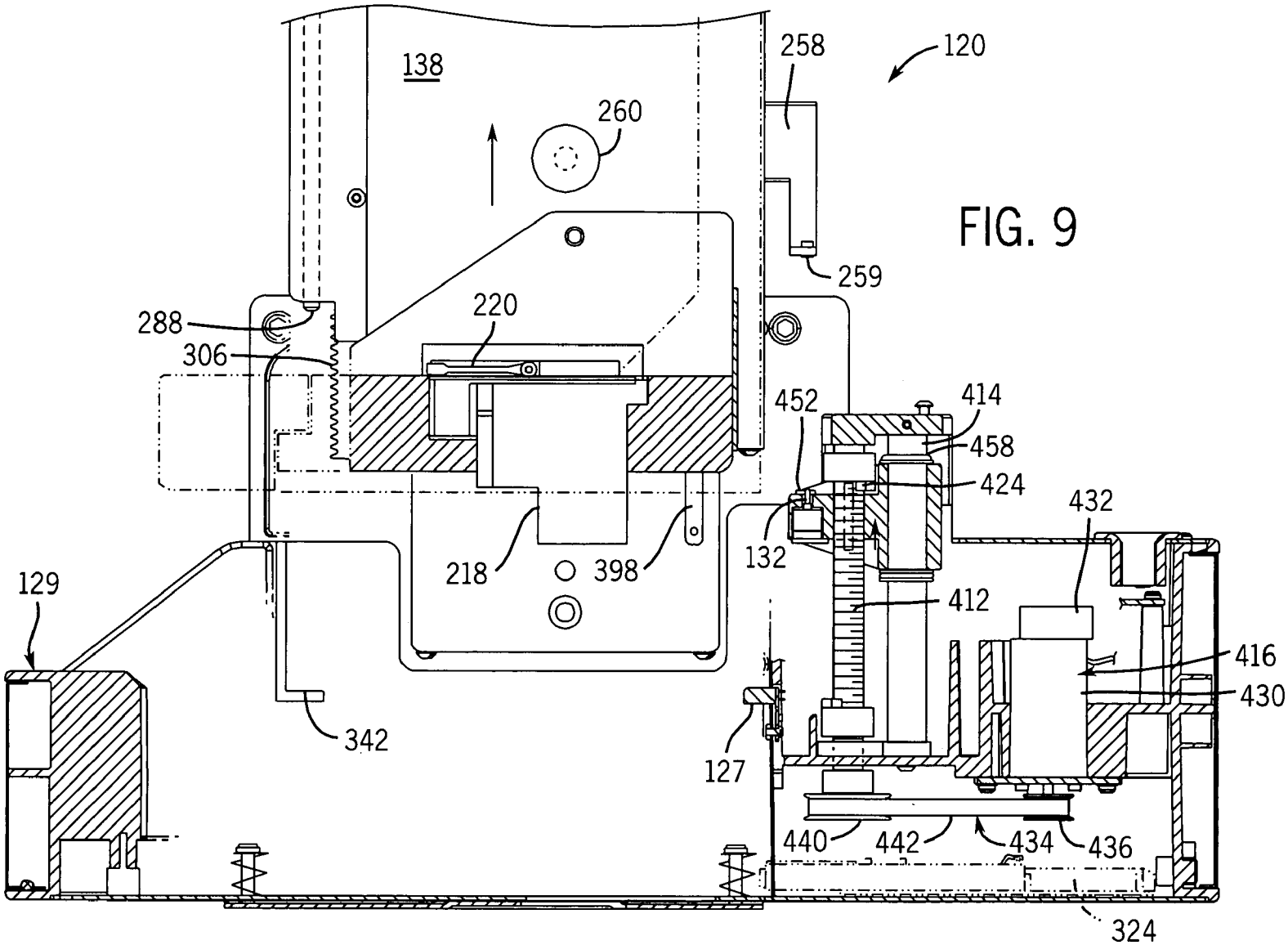
FIG. 9 is a fragmentary sectional view of the printing system of FIG. 2 illustrating the imaging head being lifted and decoupled from the elevator according to one exemplary embodiment.

As shown by FIGS. 9 and 10, imaging head 126 and mount 138 (sometimes referred to as a "brick") are configured to be further manually lifted out of the nesting relationship with chassis 320 of service station 129 to a sufficient height to allow nozzle plates of printheads 118 to be accessed and manually cleaned. In the particular example shown, imaging head 126 may also be manually lifted to a height sufficient to expose carriage 322 and printhead servicing unit 324 while within chassis 320. Once lifted to the elevated position shown, imaging head 126 and mount 138 may be releasably retained with the engagement of lock 260 with detent 252 (shown in FIG. 4) in base plate 247.

As further shown by FIG. 9, manual lifting of imaging head 126 and mount 138 to the position shown in FIG. 10 may result in exposure of moving parts such as the moving parts of service station 129 and moving parts of elevator 131. The lifting of imaging head 126 to the position shown also results in imaging head 126 (or its flag) clearing sensor 127 and results in surface 259 of arm 258 being lifted above and disengaging lift surface 452 of nut 418 so as to trip sensor 132. In response to receiving signals from sensor 127 indicating that imaging head 126 has cleared sensor 127 and in response to signals from sensor 132 indicating that imaging head 126 has been disengaged from nut 418, controller 133 (shown in FIG. 2) generates control signals cessating the supply of power to or the operation of rotary actuator 366 of service station 129 and rotary actuator 416 of elevator 131. As a result, the likelihood of operator contact with moving parts is reduced or eliminated.

In the particular example shown, imaging head 126 and mount 138 are configured to be lifted upward by a distance of nominally about 3 inches after imaging head 126 has cleared sensor 127.

Figures 11, 11A:
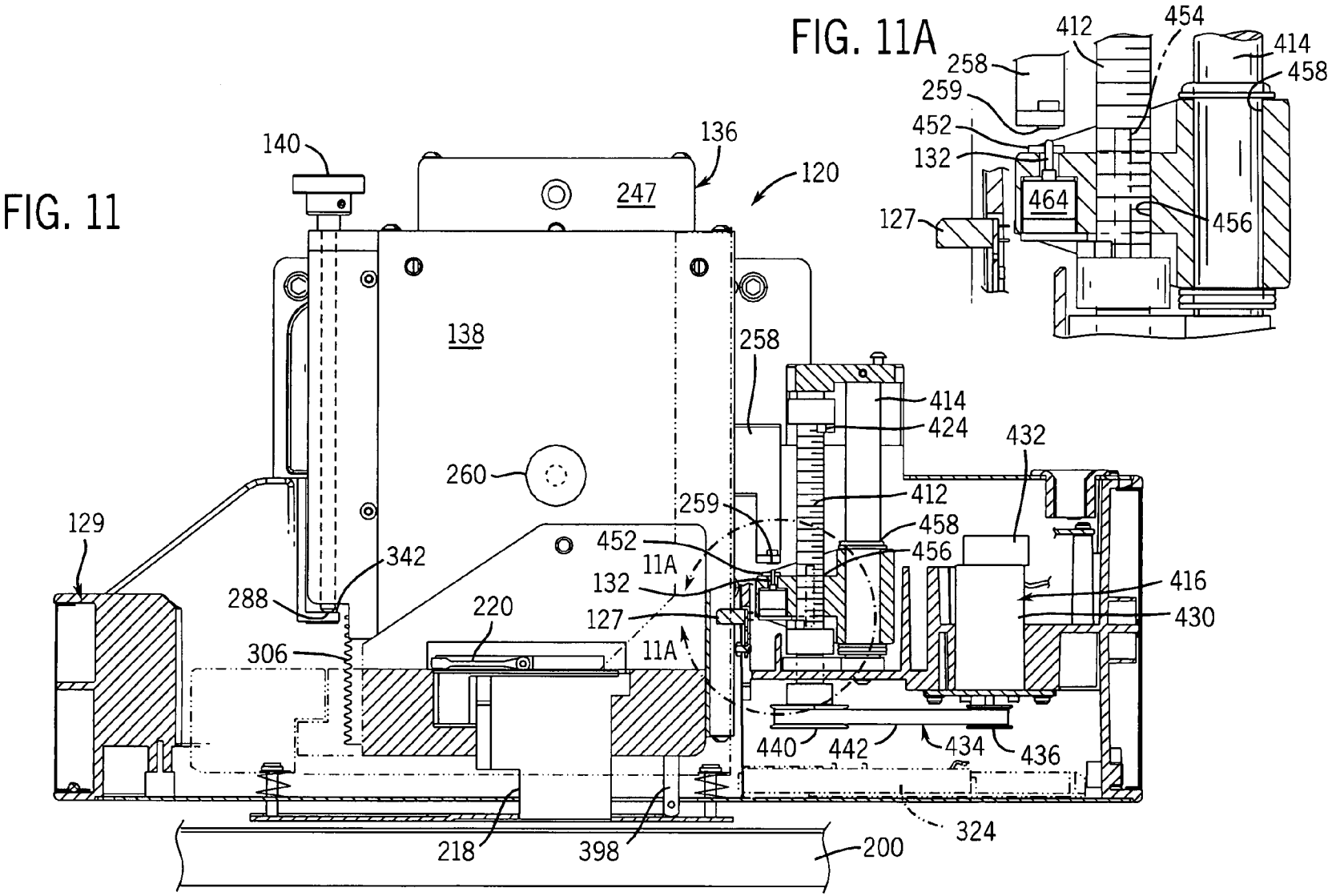
FIG. 11 is a fragmentary sectional view of the printing system of FIG. 2 illustrating the imaging head being supported by an imaging head positioner and the elevator decoupled from the imaging head according to one exemplary embodiment.
FIG. 11A is an enlarged view of FIG. 11 taken along line 11A-11A according to one exemplary embodiment.
Figures 12, 12A:
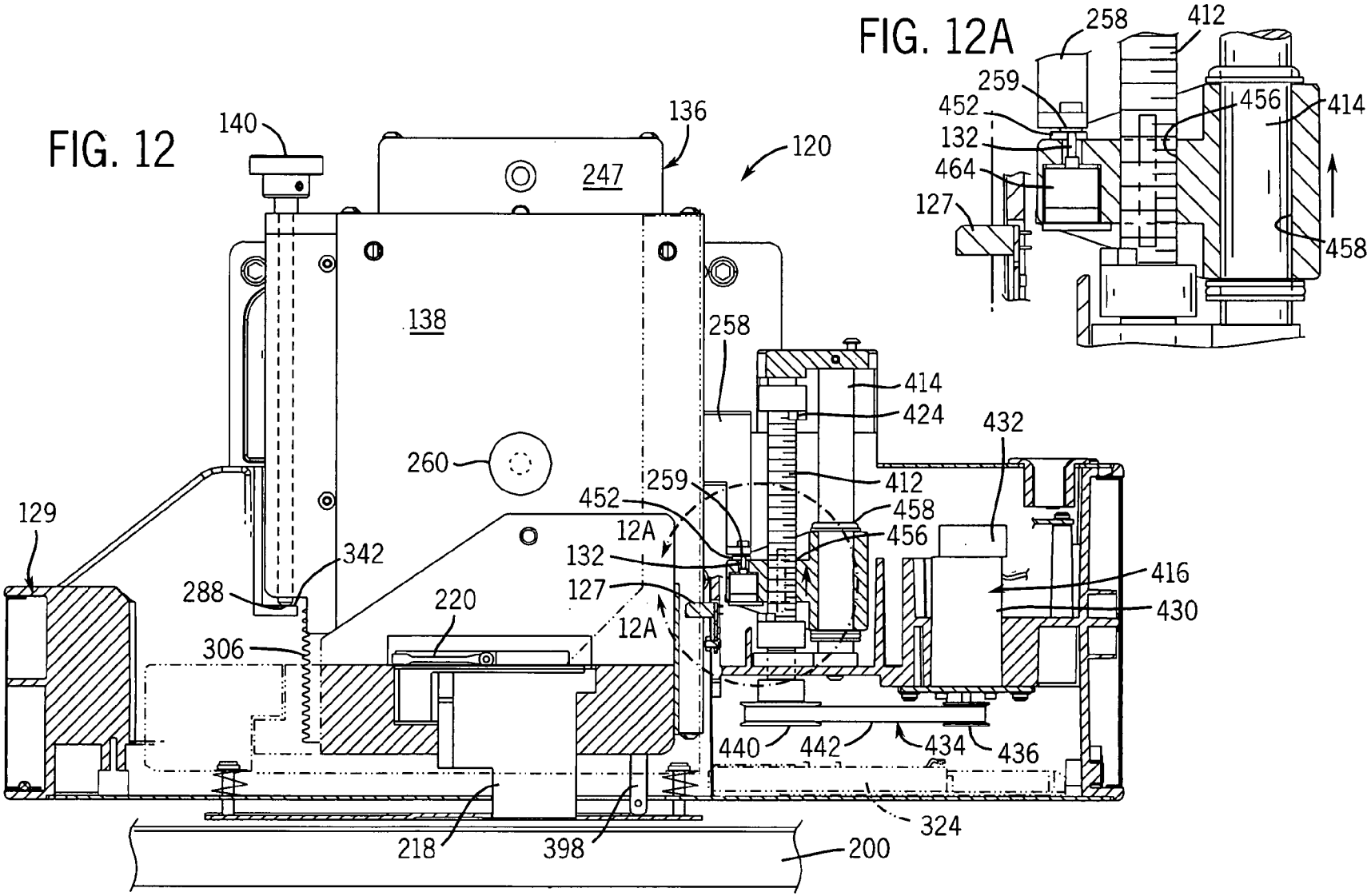
FIG. 12 illustrates the printing system of FIG. 11 after re-engagement of the elevator and the imaging head according to one exemplary embodiment.
FIG. 12A is an enlarged view of FIG. 12 taken along line 12A-12A according to one exemplary embodiment.

FIGS. 11 and 12 illustrate cooperation of elevator 131, sensor 132 and controller 133 (shown in FIG. 2) in detecting a position of positioner 140. As shown by FIG. 11, rotary actuator 430 rotates screw 412 in response to signals from controller 133 to lower nut 418 until lifting surface 452 is lowered below and disengaged from surface 259 of arm 258 which results in end imaging head 126 being lowered until tip 288 rests upon platform 342. Rotary actuator 416 continues to rotate screw 412 so as to further lower nut 418 and lifting surface 452 below and out of engagement with surface 259 of arm 258. Disengagement of lifting surface 452 from surface 259 is sensed by sensor 132 being triggered. In response to signals from sensor 132, controller 133 records the position of nut 418 as provided by encoder 432 which corresponds to the lowest point that imaging head 126 may be lowered to by rotary actuator 416.

Alternatively, as shown by FIGS. 12 and 12A, once rotary actuator 416 has lowered nut 418 to its lower end of travel to rest tip 288 of positioner 140 upon platform 342, controller 133 (shown in FIG. 2) may generate control signals directing rotary actuator 416 to drive screw 412 to raise nut 418 until lifting surface 452 is brought into engagement with or in proximity to surface 259 of arm 258 as sensed by sensor 132. Upon receiving signals from sensor 132, controller 133 may store the position of nut 418 as indicated by encoder 432, as the lower most point to which imaging head 126 may be lowered by elevator 131.

Figure 13:
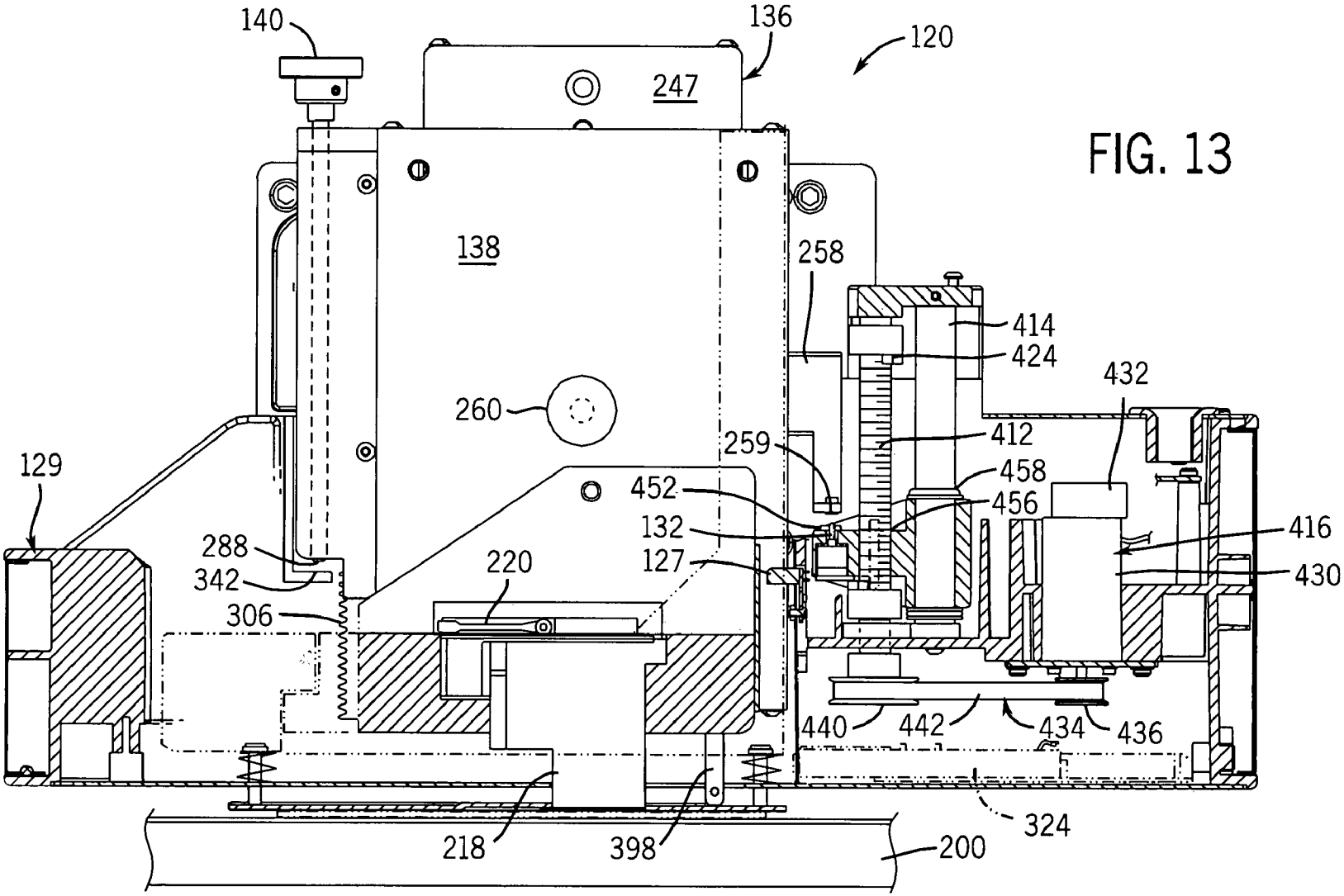
FIG. 13 is a fragmentary sectional view of the printing system of FIG. 2 illustrating the imaging head resting upon a medium and the elevator decoupled from the imaging head according to one exemplary embodiment.

FIG. 13 illustrates cooperation of elevator 131, sensor 132 and controller 133 (shown in FIG. 2) to determine a thickness of a medium 22. As shown by FIG. 13, positioner 140 is initially adjusted such that imaging head 126 may be lowered into contact with medium 22 so as to rest upon medium 22 prior to tip 288 of positioner 140 resting upon platform 342. Once positioner 140 is adjusted, controller 133 generates control signals directing elevator 131 to lower imaging head 126 until imaging head 126 and/or deflector 382 comes to rest upon medium 22. Controller 133 generates control signals causing rotary actuator 416 to continue to rotate screw 412 so as to further lower nut 418 such that lifting surface 452 is lowered out of engagement with surface 259 as indicated by sensor 132. Upon receiving signals from sensor 132 indicating disengagement or separation of lifting surface 452 from surface 259 of arm 258, controller 133 calculates the thickness of medium 22 utilizing the known position or height of nut 418 as provided by encoder 432.

Alternatively, once nut 418 has been lowered so as to disengage lifting surface 452 from surface 259 of arm 258, controller 133 may direct rotary actuator 416 to rotate screw 412 so as to lift nut 418 until lifting surface 452 is once again re-engaged with surface 259 of arm 258 as sensed by sensor 132. Upon receiving signals from sensor 132, controller 133 may calculate the thickness of media 22 based upon the known position of nut 418 as indicated by encoder 432.

Figure 14:
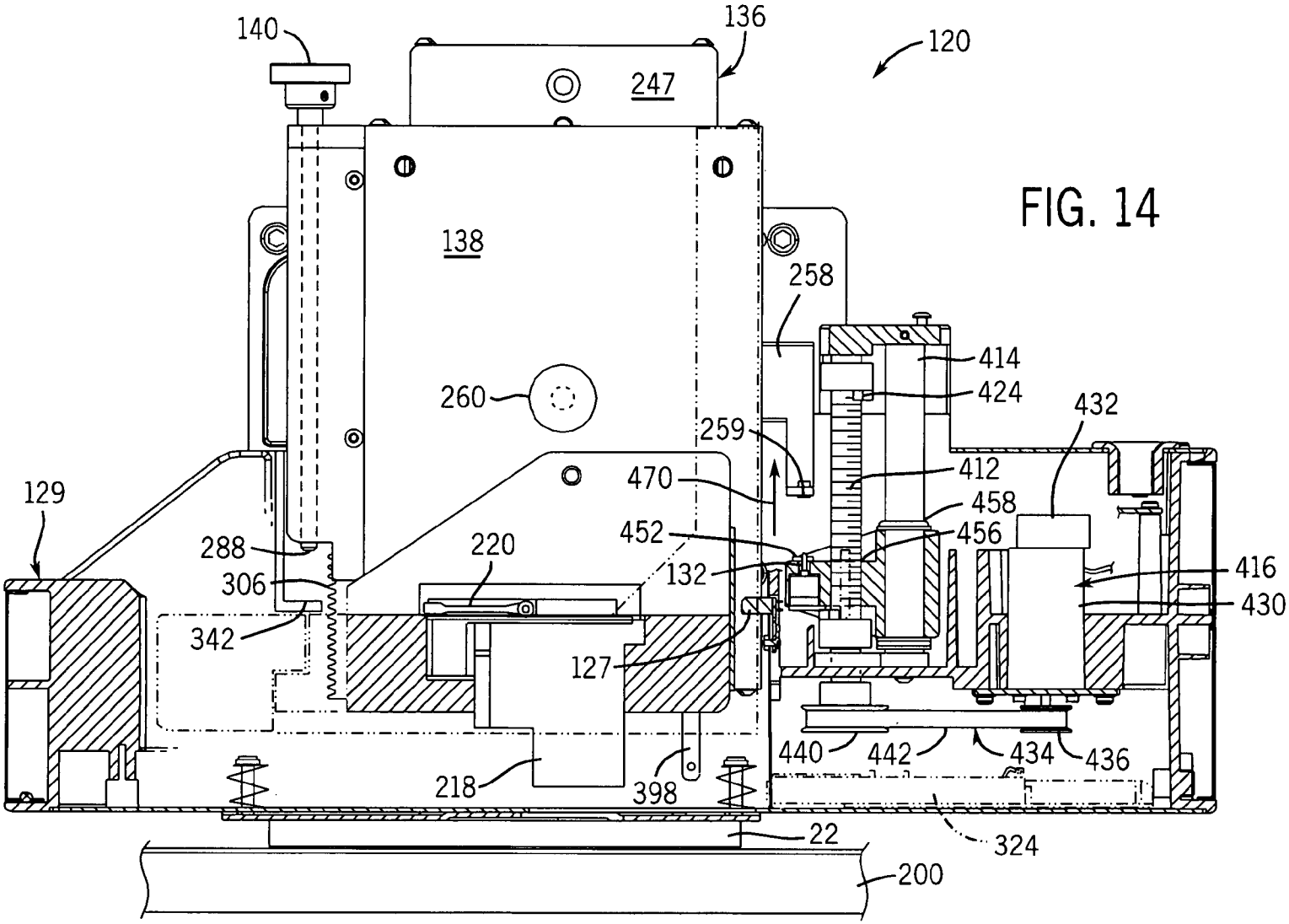
FIG. 14 is a fragmentary sectional view of the printing system of FIG. 2 illustrating decoupling of the imaging head from the elevator during a collision according to one exemplary embodiment.

FIG. 14 illustrates the use of sensor 132 to identify when imaging head 126 has experienced a collision with an obstruction. As indicated by arrow 470, upon colliding with an obstruction, such as one or more sheets of media 22 having an abnormally large thickness or bent media 22, imaging head 126 will rise so as to lift tip 288 of positioner 140 off of platform 342 and such that surface 259 will rise above lifting surface 452, triggering sensor 132. Upon receiving signals from sensor 132 indicating separation of lifting surface 452 and surface 259 of arm 258, controller 133 (shown in FIG. 2) consults its memory to identify the current positioning of nut 418 as provided by encoder 432. If the current positioning of nut 418 is at a height greater than the current positioning of tip 288 of positioner 140 (as determined and stored per the process described with respect to FIGS. 11 and 12), controller 133 may conclude that imaging head 126 has collided with an obstruction. As a result, controller 133 may additionally generate control signals communicating the determined collision to another computing device, may generate control signals causing a display or sound emitting device to notify an operator of the collision or may generate control signals to take remedial actions such as temporarily pausing printing operations by printheads 118.

Overall, printing system 20 and 120 allow the height of imaging heads 26, 126 to automatically adjust to a desired spacing with respect to media being printed on using a powered elevator. Systems 20 and 120 additionally facilitate determination of a positioning of an imaging head positioner corresponding at the lowest point to which the imaging head may be lowered, to facilitate determination of thickness of the media being printed upon and provide prompt automatic detection and notification of collisions with the imaging head. System 120 additionally facilitates raising and lowering of imaging head 126 and the extension and retraction of one or more printhead servicing units to service the printheads of imaging head 126. System 120 additionally allows imaging head 126 to be manually lifted for manual cleaning while preventing exposure of moving parts of service station 129 or elevator 131. Although system 120 is illustrated as including multiple features utilized in conjunction with one another, system 120 may alternatively utilize less than all of the noted mechanisms or features. In one embodiment, system 120 may omit sensor 127. In another embodiment, system 120 may omit service station 129. In another embodiment, service station 129 may be utilized with other mechanisms or means for raising and lowering imaging head 126 other than elevator 131.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a base;

a mount movably coupled to the base and configured to carry an imaging head; and an elevator configured to lift the mount and to permit lifting of the mount out of engagement with the elevator, wherein the mount includes a first surface and wherein the elevator includes a second surface beneath the first surface and configured to be lifted while in engagement with the first surface to lift the mount relative to the base; and a sensor configured to sense the proximity of the first surface and the second surface.

2. The apparatus of claim 1, wherein the second surface is linearly movable along a vertical axis.

3. The apparatus of claim 1, wherein the first surface is movable above and away from the second surface.

4. The apparatus of claim 1, wherein the first surface and the second surface are magnetically attracted towards one another.

5. The apparatus of claim 1 further comprising:

a third surface coupled to the base; and a fourth surface coupled to the mount, wherein the third surface engages the fourth surface to limit movement of the mount relative to the base.

6. The apparatus of claim 5, wherein the elevator is configured to move the second surface between a first position in which the second surface contacts the first surface and elevates the fourth surface above the third surface and a second position in which the fourth surface rests upon the third surface while the second surface is out of contact with the first surface.

7. The apparatus of claim 5, wherein one of the third surface and the fourth surface is adjustably supported relative to the other of the third surface and the fourth surface.

8. The apparatus of claim 5 further comprising a dampener operably coupled between the mount and the base and configured to dampen movement of the mount in a first direction to a greater degree than in a second direction.

9. The apparatus of claim 5, wherein the third surface engages the fourth surface to limit vertical movement of the mount relative to the base.

10. The apparatus of claim 9, wherein the fourth surface is carried by the mount and is adjustably supported by the mount to be moved between a plurality of vertical positions relative to the mount.

11. The apparatus of claim 1 further comprising a spring resiliently biasing the mount in an upward direction relative to the base.

12. The apparatus of claim 11 further comprising:

a deflector configured to engage media; and a shaft coupled to the deflector and having a shoulder, wherein the spring is captured between the shoulder and the mount.

13. The apparatus of claim 1, wherein the elevator comprises:

a nut;

a threaded shaft threadably engaging the nut;

a structure substantially preventing rotation of the nut; and a rotary actuator configured to rotate the shaft to move the nut along the shaft.

14. The apparatus of claim 13 further comprising a sensor configured to detect rotation of the shaft.

15. The apparatus of claim 1 further comprising an imaging head carried by the mount.

16. The apparatus of claim 15 further comprising a service station coupled to the base.

17. The apparatus of claim 16, wherein the head is nested within the service station.

18. The apparatus of claim 17 further comprising a sensor configured to sense withdrawal of the imaging head from the servicing station.

19. The apparatus of claim 16, wherein the servicing station includes at least one servicing unit horizontally movable between an extended servicing position and a retracted position.

20. The apparatus of claim 1 further comprising a media transport, wherein the base is configured to move relative to the media transport.

21. The apparatus of claim 1, wherein the mount linearly slides relative to the base.

22. The apparatus of claim 1 further comprising:

a third surface coupled to the base;

a fourth surface coupled to the mount;

a sensor configured to sense the proximity of the third surface to the fourth surface; and a controller configured to generate control signals, wherein the elevator lowers imaging head until the imaging head rests upon media in response to the control signals, wherein the elevator lowers the third surface while the member rests upon media so as to disengage the fourth surface.

23. The apparatus of claim 22, wherein the controller is configured to determine the characteristic of the media based upon signals from the sensor during disengagement of the third surface from the fourth surface.

24. The apparatus of claim 22, wherein the elevator is configured to raise the imaging head until the first surface is in sufficient proximity to the second surface so as to trigger the sensor in response to the control signals and wherein the controller is further configured to determine a characteristic of the media based upon signals received from the sensor during raising of the second surface.

25. The apparatus of claim 1 further comprising:

an imaging head carried by the mount;

a sensor configured to sense the relative positioning of the elevator and the mount;

and a controller configured to generate control signals in response to receiving a signal from the sensor indicating decoupling of the mount from the elevator.

26. An apparatus comprising:

a base;

a mount movably coupled to the base and configured to carry an imaging head;

an elevator configured to lift the mount and to permit lifting of the mount out of engagement with the elevator, wherein the mount includes a first surface and wherein the elevator includes a second surface beneath the first surface and configured to be lifted while in engagement with the first surface to lift the mount relative to the base;

a third surface coupled to the base;

a fourth surface coupled to the mount, wherein the third surface engages the fourth surface to limit movement of the mount relative to the base; and a dampener operably coupled between the mount and the base and configured to dampen movement of the mount in a first direction to a greater degree than in a second direction.

27. An apparatus comprising:

a base;

a mount movably coupled to the base and configured to carry an imaging head;

an elevator configured to lift the mount and to permit lifting of the mount out of engagement with the elevator, wherein the mount includes a first surface and wherein the elevator includes a second surface beneath the first surface and configured to be lifted while in engagement with the first surface to lift the mount relative to the base;

a spring resiliently biasing the mount in an upward direction relative to the base;

a deflector configured to engage media; and a shaft coupled to the deflector and having a shoulder, wherein the spring is captured between the shoulder and the mount.

28. An apparatus comprising:

a base;

a mount movably coupled to the base and configured to carry an imaging head;

an elevator configured to lift the mount and to permit lifting of the mount out of engagement with the elevator, wherein the mount includes a first surface and wherein the elevator includes a second surface beneath the first surface and configured to be lifted while in engagement with the first surface to lift the mount relative to the base;

a third surface coupled to the base; and a fourth surface coupled to the mount, wherein the third surface engages the fourth surface to limit movement of the mount relative to the base, wherein the elevator is configured to move the second surface between a first position in which the second surface contacts the first surface and elevates the fourth surface out of contact with and above the third surface and a second position in which the fourth surface rests upon the third surface while the second surface is out of contact with the first surface.

* * * * *